US010490176B2

(12) United States Patent
Obata et al.

(10) Patent No.: US 10,490,176 B2
(45) Date of Patent: Nov. 26, 2019

(54) AUTOMATIC ACCOMPANIMENT APPARATUS AND AUTOMATIC ACCOMPANIMENT METHOD

(71) Applicant: YAMAHA CORPORATION, Hamamatsu-shi (JP)

(72) Inventors: Kainosuke Obata, Hamamatsu (JP); Tomota Nakamura, Kawasaki (JP)

(73) Assignee: YAMAHA CORPORATION, Hamamatsu-Shi (JP)

( * ) Notice: Subject to any disclaimer, the term of this patent is extended or adjusted under 35 U.S.C. 154(b) by 0 days.

(21) Appl. No.: 15/920,601

(22) Filed: Mar. 14, 2018

(65) Prior Publication Data

US 2018/0268795 A1 Sep. 20, 2018

(30) Foreign Application Priority Data

Mar. 17, 2017 (JP) ..... 2017-052481

(51) Int. Cl.
*G10H 1/36* (2006.01)
*G10H 1/00* (2006.01)

(52) U.S. Cl.
CPC ..... *G10H 1/368* (2013.01); *G10H 1/0008* (2013.01); *G10H 2210/011* (2013.01); *G10H 2210/071* (2013.01); *G10H 2210/076* (2013.01); *G10H 2220/091* (2013.01)

(58) Field of Classification Search
CPC ..... G10H 1/0025; G10H 1/0008; G10H 1/36; G10H 1/368; G10H 1/40; G10H 1/365; G10H 1/361; G10H 2210/076; G10H 2210/341; G10H 1/0033; G10G 1/00; G10G 1/02; G10G 3/04
See application file for complete search history.

(56) References Cited

U.S. PATENT DOCUMENTS 5,532,425 A * 7/1996 Nakata ..... G10H 1/0033 84/609
5,623,112 A * 4/1997 Ito ..... G10H 1/0033 84/610
5,712,436 A * 1/1998 Sakama ..... G10H 1/36 84/610

(Continued)

FOREIGN PATENT DOCUMENTS

JP 02071296 A 3/1990
JP 07046276 B2 5/1995

*Primary Examiner* — Marlon T Fletcher
(74) *Attorney, Agent, or Firm* — Rossi, Kimms & McDowell LLP

(57) ABSTRACT

An automatic accompaniment apparatus including a determiner that determines a current position in a music piece in progress, a selector that selects an accompaniment element data set to be used out of a plurality of accompaniment element data sets every time the determined current position arrives at a predetermined switching position, an accompaniment data generator that generates accompaniment data indicating automatic accompaniment based on the selected accompaniment element data set, a calculator that calculates time information corresponding to a time required until the determined current position arrives at a next switching position, and a display controller that controls a display to display arrival advance notice information indicating the calculated time information.

20 Claims, 16 Drawing Sheets

(56) References Cited

U.S. PATENT DOCUMENTS

| | | | | | |
|---|---|---|---|---|---|
| 5,739,456 | A * | 4/1998 | Shimada | G10H 1/36 | 84/622 |
| 5,756,917 | A * | 5/1998 | Watanabe | G10H 1/36 | 84/634 |
| 5,831,195 | A * | 11/1998 | Nakata | G10H 1/36 | 84/609 |
| 6,211,453 | B1 * | 4/2001 | Kurakake | G10H 1/26 | 84/477 R |
| 2002/0105359 | A1 * | 8/2002 | Shimizu | G10H 7/02 | 327/1 |
| 2010/0313736 | A1 * | 12/2010 | Lenz | G09B 15/02 | 84/477 R |
| 2012/0097014 | A1 * | 4/2012 | Matsumoto | G10H 1/0033 | 84/634 |
| 2013/0305902 | A1 * | 11/2013 | Okazaki | G10H 1/38 | 84/604 |
| 2013/0305907 | A1 * | 11/2013 | Kakishita | G10H 1/38 | 84/613 |
| 2013/0340593 | A1 * | 12/2013 | Uemura | G10H 7/00 | 84/604 |
| 2013/0340594 | A1 * | 12/2013 | Uemura | G10H 7/04 | 84/605 |
| 2014/0060287 | A1 * | 3/2014 | Okuda | G10H 1/40 | 84/612 |

* cited by examiner

AUTOMATIC ACCOMPANIMENT SCREEN

AUTOMATIC ACCOMPANIMENT APPARATUS AND AUTOMATIC ACCOMPANIMENT METHOD

BACK GROUND OF THE INVENTION

Field of the Invention

The present invention relates to an automatic accompaniment apparatus and an automatic accompaniment method.

Description of Related Art

Electronic musical instruments including a function that provides automatic accompaniment to a user's performance based on pre-stored accompaniment pattern data have been known. In an electronic musical instrument described in JP 7-46276 B2, five types of accompaniment patterns including one type of a normal pattern, three types of variation patterns and one type of a fill-in pattern are stored. When a user performs a keyboard operation, an accompaniment pattern corresponding to the strength of hit of a key is selected. For example, an initial touch average strength signal is generated based on a velocity of hit of the key, and the variation pattern corresponding to the generated signal level is selected out of the three types of variation patterns.

In the electronic musical instrument described in the above mentioned JP 7-46276 B2, the accompaniment patterns are switched according to the strength of hit of a key regardless of a position in a music piece. In this case, the automatic accompaniment that is generated based on a accompaniment pattern changes unnaturally depending on a position at which the accompaniment patterns are switched. On the other hand, even in the case where a switching position of an accompaniment pattern is preset according to the structure of a music piece, when the accompaniment pattern is switched abruptly with a user not recognizing the switching position of the accompaniment pattern, a user's performance is disturbed. Thus, a mistake of a user's performance such as a mistake of depression of a key or a mismatch in rhythm may occur.

An object of the present invention is to provide an automatic accompaniment apparatus and an automatic accompaniment method for enabling prevention of an unnatural change of automatic accompaniment and enabling prevention of an occurrence of a mistake of performance due to a change of the automatic accompaniment.

BRIEF SUMMARY OF THE INVENTION

An automatic accompaniment apparatus according to one aspect of the present invention includes a determiner that determines a current position in a music piece in progress, a selector that selects an accompaniment element data set to be used out of a plurality of accompaniment element data sets every time the determined current position arrives at a predetermined switching position, an accompaniment data generator that generates accompaniment data indicating automatic accompaniment based on the selected accompaniment element data set, a calculator that calculates time information corresponding to a time required until the determined current position arrives at a next switching position, and a display controller that controls a display to display arrival advance notice information indicating the calculated time information.

In an embodiment, the automatic accompaniment apparatus may further include a tempo acquirer that acquires a tempo of the music piece, wherein the determiner may calculate the current position based on the acquired tempo.

In an embodiment, the automatic accompaniment apparatus may further include a performance data acquirer that acquires performance data indicating a user's performance, wherein the determiner may calculate the current position based on music piece data indicating the music piece and the acquired performance data.

In an embodiment, the plurality of accompaniment element data sets may include a plurality of main accompaniment element data sets to be used in each of a plurality of main sections which are body portions of the music piece, and a plurality of fill-in accompaniment element data sets to be used in a fill-in section which is disposed between at least two main sections. The switching position may be a starting position of each main section, and a starting position of the fill-in section may be set at a position a predetermined period before the switching position. The selector may select a main accompaniment element data set to be used out of the plurality of main accompaniment element data sets every time the current position arrives at the switching position, and may select a fill-in accompaniment element data set to be used out of the plurality of fill-in accompaniment element data sets every time the current position arrives at the starting position of the fill-in section. The display controller may control the display to further display fill-in information indicating that the current position is in the fill-in section when the fill-in accompaniment element data set is selected by the selector.

In an embodiment, the display controller may control the display to further display a current position-in-measure indicating a relationship between the current position and a starting or ending position of a measure including the current position.

In an embodiment, the automatic accompaniment apparatus may further include a performance data acquirer that acquires performance data indicating a user's performance, and a volume detector that detects a volume of the user's performance based on the acquired performance data, wherein the selector may select an accompaniment element data set to be used based on the detected volume.

In an embodiment, the display controller may control the display to further display volume information indicating the detected volume.

In an embodiment, the time information may include a real time. The time information may include a length in a musical score.

In an embodiment, each accompaniment element data set may include accompaniment pattern data, and the accompaniment data generator may generate the accompaniment data corresponding to the current position based on the selected accompaniment pattern data.

In an embodiment, the display controller may control the display to display beat position information indicating which beat position in a measure the current position is at.

In an embodiment, the plurality of accompaniment element data sets may correspond to combinations of a plurality of types of sections and a plurality of variations, and the display controller may control the display to display variation information indicating a variation at the current position.

An automatic accompaniment apparatus according to another aspect of the present invention includes a processor that is configured to determine a current position in a music piece in progress, select an accompaniment element data set to be used out of a plurality of accompaniment element data sets every time the determined current position arrives at a predetermined switching position, generate accompaniment data indicating automatic accompaniment based on the selected accompaniment element data set, and calculate time information corresponding to a time required until the determined current position arrives at a next switching position, and a display that is configured to display arrival advance notice information indicating the calculated time information.

An automatic accompaniment method according to yet another aspect of the present invention includes determining a current position in a music piece in progress, selecting an accompaniment element data set to be used out of a plurality of accompaniment element data sets every time the determined current position arrives at a predetermined switching position, generating accompaniment data indicating automatic accompaniment based on the selected accompaniment element data set, calculating time information corresponding a time required until the determined current position arrives at a next switching position, and controlling a display to display arrival advance notice information indicating the calculated time information.

In an embodiment, the automatic accompaniment method may further include acquiring a tempo of the music piece, wherein the determining a current position may include calculating the current position based on the acquired tempo.

In an embodiment, the automatic accompaniment method may further include acquiring performance data indicating a user's performance, wherein the determining a current position may include calculating the current position based on music piece data indicating the music piece and the acquired performance data.

In an embodiment, the plurality of accompaniment element data sets may include a plurality of main accompaniment element data sets to be used in each of a plurality of main sections which are body portions of the music piece, and a plurality of fill-in accompaniment element data sets to be used in a fill-in section which is disposed between at least two main sections. The switching position may be a starting position of each main section, and a starting position of the fill-in section may be set at a position a predetermined period before the switching position. The selecting an accompaniment element data set to be used may include selecting a main accompaniment element data set to be used out of the plurality of main accompaniment element data sets every time the current position arrives at the switching position, and selecting a fill-in accompaniment element data set to be used out of the plurality of fill-in accompaniment element data sets every time the current position arrives at the starting position of the fill-in section. The method may further include controlling the display to display fill-in information indicating that the current position is in the fill-in section when the fill-in accompaniment element data set is selected.

In an embodiment, the automatic accompaniment method may further include controlling the display to further display a current position-in-measure indicating a relationship between the current position and a starting or ending position of a measure including the current position.

In an embodiment, the automatic accompaniment method may further include acquiring performance data indicating a user's performance, and detecting a volume of the user's performance based on the acquired performance data, wherein the selecting an accompaniment element data set to be used may include selecting an accompaniment element data set to be used based on the detected volume.

In an embodiment, the automatic accompaniment method may further include controlling the display to further display volume information indicating the detected volume.

THE DESCRIPTION OF THE PREFERRED EMBODIMENTS

An automatic accompaniment apparatus and an automatic accompaniment method according to embodiments of the present invention will be mentioned below in detail with reference to the drawings.

[1] Configuration of Electronic Musical Apparatus

Figure 1:
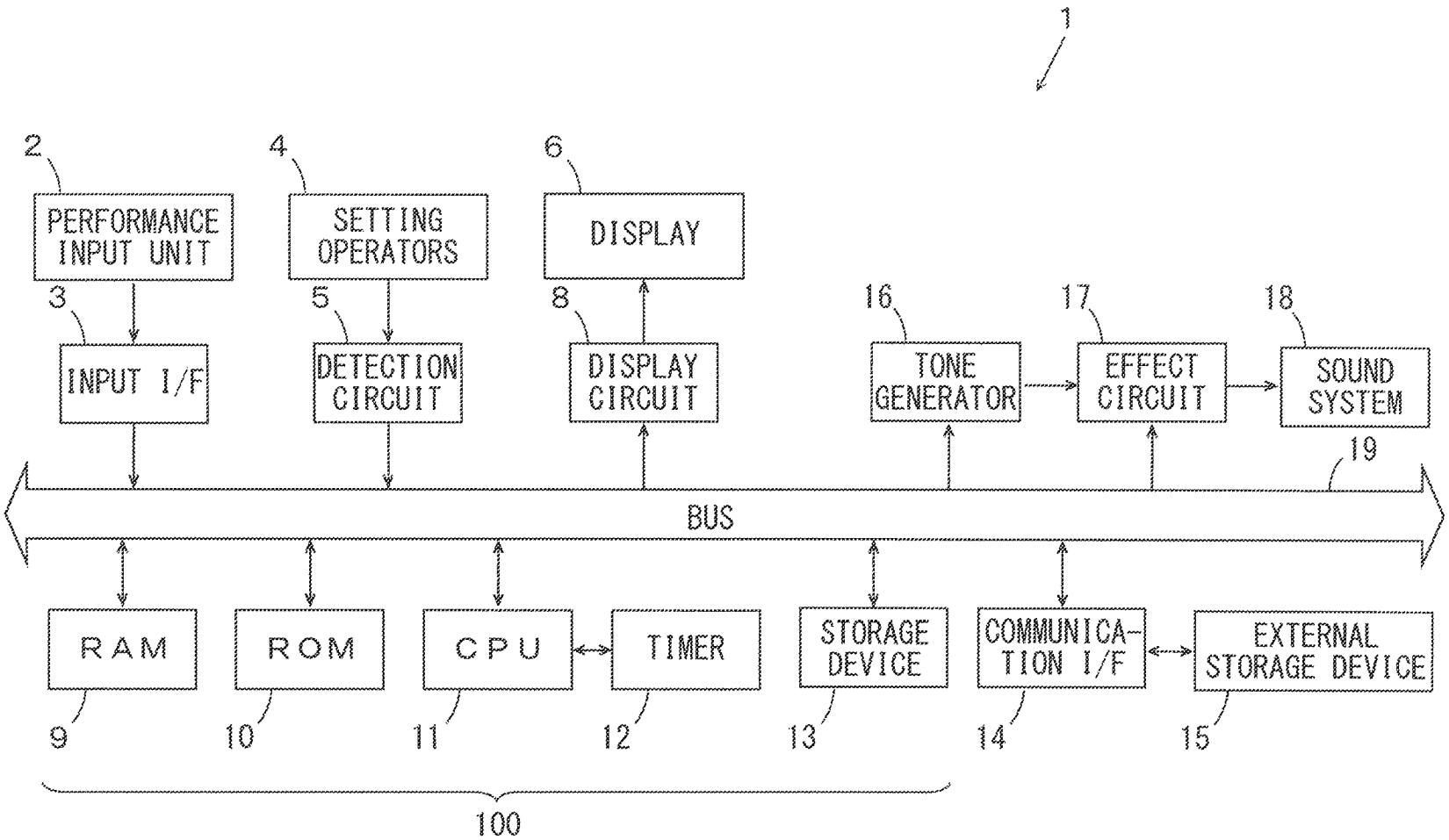
FIG. 1 is a block diagram showing a configuration of an electronic musical apparatus.

FIG. 1 is a block diagram showing a configuration of the electronic musical apparatus including the automatic accompaniment apparatus according to an embodiment of the present invention. Using the electronic musical apparatus 1 of FIG. 1, a user can perform and produce music, for example. The electronic musical apparatus 1 also includes the automatic accompaniment apparatus 100 that provides automatic accompaniment.

The electronic musical apparatus 1 comprises a performance input unit 2, an input I/F (interface) 3, setting operators 4, a detection circuit 5, a display 6 and a display circuit 8. The performance input unit 2 includes a pitch specifying operator such as a keyboard or a microphone, and is connected to a bus 19 through the input I/F 3. When the user performs music, performance data showing contents of the user's performance is input by the performance input unit 2. The performance data is MIDI (Musical Instrument Digital Interface) Data or audio data. The setting operators 4 include switches that are operated in an on-off manner, rotary encoders that are operated in a rotational manner, linear encoders that are operated in a sliding manner, etc., and are connected to the bus 19 through the detection circuit 5. The setting operators 4 are used for adjustment of the volume, on-off of a power supply and various settings. The display 6 includes a liquid crystal display, for example, and is connected to the bus 19 through the display circuit 8. Various information related to performance, settings, etc. is displayed on the display 6. At least a part of the performance input unit 2, the setting operators 4 and the display 6 may be constituted by a touch panel display.

The electronic musical apparatus 1 further includes a RAM (Random Access Memory) 9, a ROM (Read Only Memory) 10, a CPU (Central Processing Unit) 11, a timer 12 and a storage device 13. The RAM 9, the ROM 10, the CPU 11 and the storage device 13 are connected to the bus 19. The timer 12 is connected to the CPU 11. An external device such as an external storage device 15 may be connected to the bus 19 via a communication I/F (interface) 14. The RAM 9, the ROM 10, the CPU 11 and the timer 12 constitute a computer.

The RAM 9 is a volatile memory, for example, which is used as a working area for the CPU 11, and temporarily stores various data. The ROM 10 is a nonvolatile memory, for example, and stores a computer program such as a control program and an automatic accompaniment program. The CPU 11 executes the automatic accompaniment program stored in the ROM 10 on the RAM 9 to perform automatic accompaniment processing mentioned below and generates accompaniment data. The timer 12 provides clock information such as a current time to the CPU 11.

The storage device 13 includes a storage media such as a hard disc, an optical disc, a magnetic disc or a memory card, and stores one or a plurality of music piece structure data sets. Each music piece structure data set indicates the structure of a music piece and includes a type of a section corresponding to each period in the music piece. The types of a section mean roles relating to progress of the music piece, and are "introduction" to be inserted into the head portion of the music piece, "main" which is the body of the music piece, "fill-in" to be inserted into a connecting portion or the like of measures or musical passages, and "ending" to be inserted into the end portion of the music piece, for example. Further, a music piece structure data set includes time position information (measure information, for example) corresponding to each period. The music piece structure data sets may be stored in association with each music piece together with another attached data. Examples of the other attached data include music piece data constituted by MIDI data or audio data, lyrics data, music score displaying data, chord progressing data, guide data for supporting a performance of a certain part such as a main melody, comment (memorandum) data, recommended automatic accompaniment data sets and tone (timbre) and the like.

The storage device 13 further stores one or a plurality of automatic accompaniment data sets. The details of the automatic accompaniment data sets will be mentioned below. The above mentioned automatic accompaniment program may be stored in the storage device 13. The external storage device 15 includes a storage media such as a hard disc, an optical disc, a magnetic disc or a memory card, similarly to the storage device 13, and may store the music piece structure data sets, the automatic accompaniment data sets or the automatic accompaniment program.

The automatic accompaniment program of the present embodiment may be supplied in the form of being stored in a recording media which is readable by a computer, and installed in the ROM 10 or the storage device 13. In addition, in the case where the communication I/F 14 is connected to a communication network, the automatic accompaniment program delivered from a server connected to the communication network may be installed in the ROM 10 or the storage device 13. Similarly, the music piece structure data sets or the automatic accompaniment data sets may be acquired from a storage media, or may be acquired from a server connected to the communication network.

The electronic musical apparatus 1 further includes a tone generator 16, an effect circuit 17 and a sound system 18. The tone generator 16 and the effect circuit 17 are connected to the bus 19, and the sound system 18 is connected to the effect circuit 17. The tone generator 16 generates a music sound signal based on the performance data input from the performance input unit 2 or the accompaniment data generated by the CPU 11, etc. The effect circuit 17 gives acoustic effects to the music sound signal generated by the tone generator 16.

The sound system 18 includes a digital-analogue (D/A) conversion circuit, an amplifier and a speaker. The sound system 18 converts the music sound signal supplied through the effect circuit 17 from the tone generator 16 into an analogue sound signal, and generates a sound based on the analogue sound signal. Thus, the music sound signal is reproduced. In the electronic musical apparatus 1, mainly the performance input unit 2, the display 6, the RAM 9, the ROM 10, the CPU 11 and the storage device 13 constitute the automatic accompaniment apparatus 100.

[2] Automatic Accompaniment Data Sets

Figure 2:
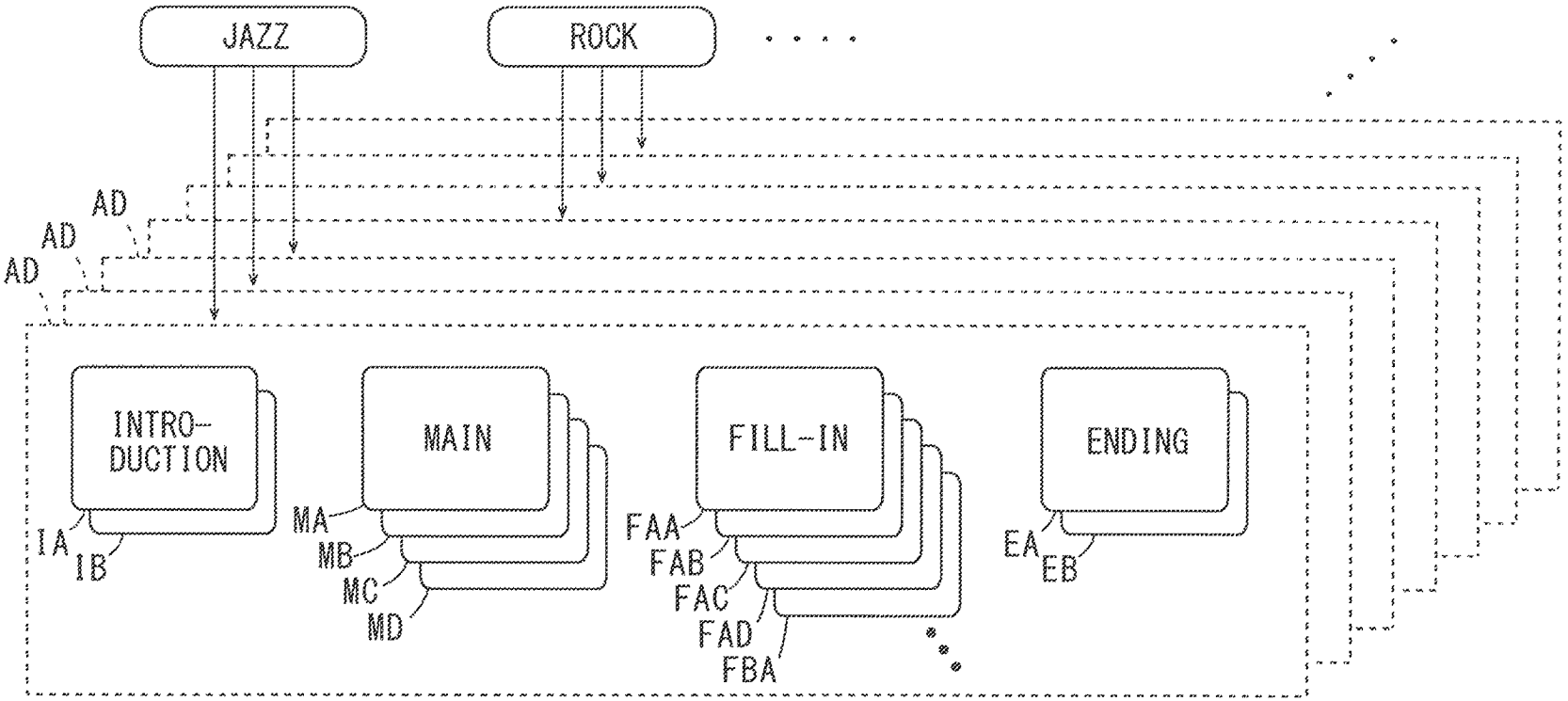
FIG. 2 is a block diagram for explaining an example of automatic accompaniment data sets.

FIG. 2 is a block diagram for explaining an example of the automatic accompaniment data sets. As shown in FIG. 2, one or a plurality of automatic accompaniment data sets AD are prepared for each category such as jazz, rock or classic (not shown). Such categories may be provided hierarchically. For example, hard rock, progressive rock and the like may be provided as subcategories of rock. Each automatic accompaniment data set AD includes a plurality of accompaniment element data sets.

The plurality of accompaniment element data sets are classified into data sets for an "introduction" section, data sets for a "main" section, data sets for a "fill-in" section and data sets for an "ending" section. "Introduction," "main," "fill-in" and "ending" indicate types of sections, respectively, and are indicated with alphabet letters "I," "M," "F" and "E," respectively. The plurality of accompaniment element data sets correspond to a plurality of variations of these sections, respectively.

The variations of the "introduction" section, the "main" section and the "ending" section indicate an atmosphere or a degree of climax of the automatic accompaniment. In the present example, the variations are indicated by alphabet letters "A" (normal (calm)), "B" (a little brilliant), "C" (brilliant), "D" (very brilliant) and so on in accordance with the degree of climax.

Because the "fill-in" section is a connection (fill-in) between other sections, the variation of the "fill-in" section is indicated by a combination of two alphabet letters corresponding to a change of the atmosphere or the degree of the climax of the sections before and after the "fill-in" section. For example, the variation "AC" corresponds to a change from "calm" to "brilliant."

Each accompaniment element data set is indicated by a combination of an alphabet letter indicative of the type of the section and an alphabet letter indicative of the variation. For example, the type of the section of an accompaniment element data set MA is "main," and the variation thereof is "A." Also, the type of the section of an accompaniment element data set FAB is "fill-in," and the variation thereof is "AB."

Each accompaniment element data set includes accompaniment pattern data of a plurality of tracks (accompaniment parts) such as a base track and a phrase track, and includes reference chord information and a pitch conversion rule (pitch conversion table information, a sound range, a sound regeneration rule at the time of chord change and so on). The accompaniment pattern data is a note sequence in the MIDI format or phrase data in the audio format, and can be converted into a phrase of any pitches based on the reference chord information and the pitch conversion rule. The number of the accompaniment tracks, the note sequence of the accompaniment pattern data and the like are different depending on the corresponding variation.

For example, the user operates the setting operators 4 of FIG. 1 to specify one music piece structure data set by selecting a desired music piece from a plurality of previously registered music pieces, to select a desired category from the plurality of categories and to specify one automatic accompaniment data set AD corresponding to the category. An automatic accompaniment sound is generated from the sound system 18 of FIG. 1 based on the specified music piece structure data set and the specified automatic accompaniment data set AD.

[3] Selection of Accompaniment Element Data Set

Figure 3:
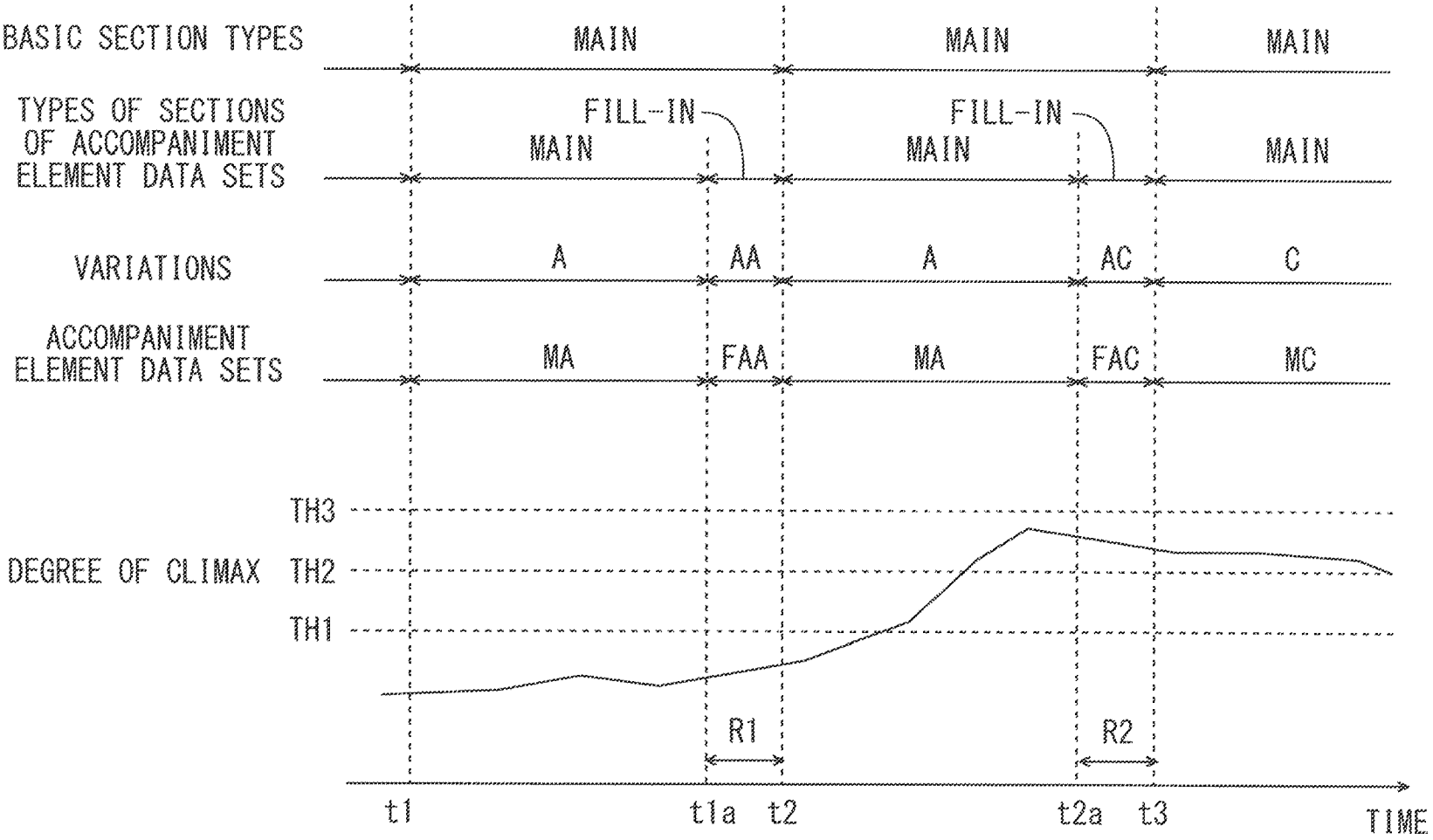
FIG. 3 is a diagram for explaining selection of an accompaniment element data set.

In the present embodiment, every time a current position in a music piece in progress arrives at a predetermined switching position, an accompaniment element data set to be used is selected out of a plurality of accompaniment element data sets included in the specified automatic accompaniment data set AD. Here, "progress of a music piece" means that at least one of an automatic accompaniment and a user's musical performance progresses. In addition, a current position in a music piece means a position at a current time point in automatic accompaniment data for the music piece in an automatic accompaniment or a musical performance. FIG. 3 is a diagram for explaining selection of accompaniment element data sets in "main" sections. In the following explanation, an accompaniment element data set for a "main" section is referred to as a main accompaniment element data set, and an accompaniment element data set for a "fill-in" section is referred to as a fill-in accompaniment element data set.

In FIG. 3, the types of sections indicated by music piece structure data sets (hereinafter referred to as basic section types), the types of sections of accompaniment element data sets that are actually used, and accompaniment element data sets to be selected are shown. In FIG. 3, the basic section types are "main." The abscissa is a time axis.

In the present example, a switching position is set every predetermined number of measures (hereinafter referred to as the number of measures between switchings). Each switching position is set at the starting position of a "main" section. In the example of FIG. 3, time points t1, t2, t3 correspond to switching positions, respectively.

Accompaniment pattern data constituting each main accompaniment element data set is composed of a note sequence of four measures, for example. In that case, an automatic accompaniment based on each accompaniment element data set forms a musical unity that has a unit constituted by four measures. When the main accompaniment element data set to be used is changed at a position that is not the ending position of each unit, the automatic accompaniment is likely to be unnatural. Therefore, when each accompaniment pattern data is composed of a unit of four measures, the number of measures between switchings is preferably a multiple of four. If an interval between switching positions is too long, the automatic accompaniment is likely to be monotonous since the automatic accompaniment based on the same main accompaniment element data set continues long. Therefore, the number of measures between switchings is set to be four measures or eight measures, for example.

In the present example, a volume of the musical performance is detected from the performance data at a predetermined detection cycle of time (20 ms cycle, for example). The volume means strength or weakness of the musical performance. Specifically, the volume is determined by the velocity of a sound, the number of keys which are depressed at the same time or the like. At each switching position, the variation of the "main" section is determined based on the detected volume and a predetermined volume reference, and the main accompaniment element data set corresponding to the determined variation is selected.

In the example of FIG. 3, the volume reference includes threshold values TH1, TH2, TH3. When the volume at a switching position is lower than the threshold value TH1, the variation is determined as "A." When the volume at a switching position is not lower than the threshold value TH1 and lower than the threshold value TH2, the variation is determined as "B." When the volume at a switching position is not lower than the threshold value TH2 and lower than the threshold value TH3, the variation is determined as "C." When the volume at a switching position is not lower than the threshold value TH3, the variation is determined as "D."

At time points t1, t2, since the volume is lower than the threshold value TH1, the variation is determined as "A." At a time point t3, since the volume is not lower than the threshold value TH2 and lower than the threshold value TH3, the variation is determined as "C." Accordingly, at the time points t1, t2, the main accompaniment element data set MA is selected, and at the time point t3, the main accompaniment element data set MC is selected.

In the example of FIG. 3, "fill-in" sections are inserted between "main" sections. In this case, the starting position (hereinafter, referred to as the fill-in starting position) of each "fill-in" section is set before each switching position. The fill-in starting position is a position two beats before the switching position, for example. The "fill-in" section is inserted in the period from the fill-in starting position to the switching position. Insertion or non-insertion of the "fill-in" section, and the interval between the switching position and the fill-in starting position may be predetermined, or may be settable appropriately by the user. Further, the fill-in starting position may be appropriately changed according to the user's performance, the tempo or the like.

At the fill-in starting position, the variation of the "fill-in" section is determined, and the fill-in accompaniment element data set corresponding to the determined variation is selected. In this case, the variation of the "fill-in" section is determined so as to correspond to the variations of the "main" sections before and after the "fill-in" section.

In the example of FIG. 3, a time point t1*a* right before the time point t2 and a time point t2*a* right before the time point t3 are set as the fill-in starting positions, and the "fill-in" sections are inserted into the period R1 from the time point t1*a* to the time point t2 and the period R2 from the time point t2*a* to the time point t3, respectively. Since the variations of the "main" sections before and after the period R1 are both "A," the variation of the "fill-in" section in the period R1 is determined as "AA." As such, a fill-in accompaniment element data set FAA is selected at the time point t1*a*. Since the variations of the "main" sections before and after the period R2 are "A" and "C," respectively, the variation of the "fill-in" section in the period R2 is determined as "AC." As such, a fill-in accompaniment element data set FAC is selected at the time point t2*a*.

Out of the variations of the "main" sections before and after each "fill-in" section, the variation of the later "main" section is provisionally determined at the fill-in starting position. Specifically, at the time point t1*a*, since the volume is lower than the threshold value TH1, the variation of the "main" section after the period R1 is provisionally determined as "A." Also, at the time point t2*a*, since the volume is not lower than the threshold value TH2 and lower than the threshold value TH3, the variation of the "main" section after the period R2 is provisionally determined as "C."

The accompaniment data is generated based on the selected accompaniment element data set, and an automatic accompaniment sound based on the generated accompaniment data is output. In the example of FIG. 3, an automatic accompaniment sound based on the main accompaniment element data set MA is output during the period from the time point t1 to the time point t1*a*, and an automatic accompaniment sound based on the fill-in accompaniment element data set FAA is output during the period from the time point t1*a* to the time point t2. Further, an automatic accompaniment sound based on the main accompaniment element data set MA is output during the period from the time point t2 to the time point t2*a*, and an automatic accompaniment sound based on the fill-in accompaniment element data set FAC is output during the period from the time point t2*a* to the time point t3. Furthermore, an automatic accompaniment sound based on the main accompaniment element data set MC is output during the period from the time point t3.

An insertion condition of a "fill-in" section may be optionally settable by the user. For example, "fill-in" sections may be inserted before all the switching positions. A "fill-in" section may be inserted only before the switching position specified by the user. Further, a "fill-in" section may be inserted only when the variation of a "main" section is switched. In this case, the "fill-in" section is not inserted in the period R1 of FIG. 3, and the "fill-in" section is inserted in the period R2.

Similarly to the example of FIG. 3, also in an "introduction" section and an "ending" section, the variations may be switched at preset switching positions. In this case, different volume references may be set for each type of a section.

The variation of the next section may be determined based on the volume at a position different from each switching position, not the volume at each switching position. For example, the variation of the next section may be determined based on the volume at the fill-in starting position before each switching position.

The current automatic accompaniment data set AD may be changed to the specified automatic accompaniment data set AD during the output of the automatic accompaniment sound (in the music piece). For example, the user may operate the setting operators 4 of FIG. 1 to change the current automatic accompaniment data set AD to the specified automatic accompaniment data set AD while performing music together with the automatic accompaniment. Further, the music piece may be divided into a plurality of periods, and an automatic accompaniment data set AD may be specified for each period.

[4] Display Screen

Figure 4:
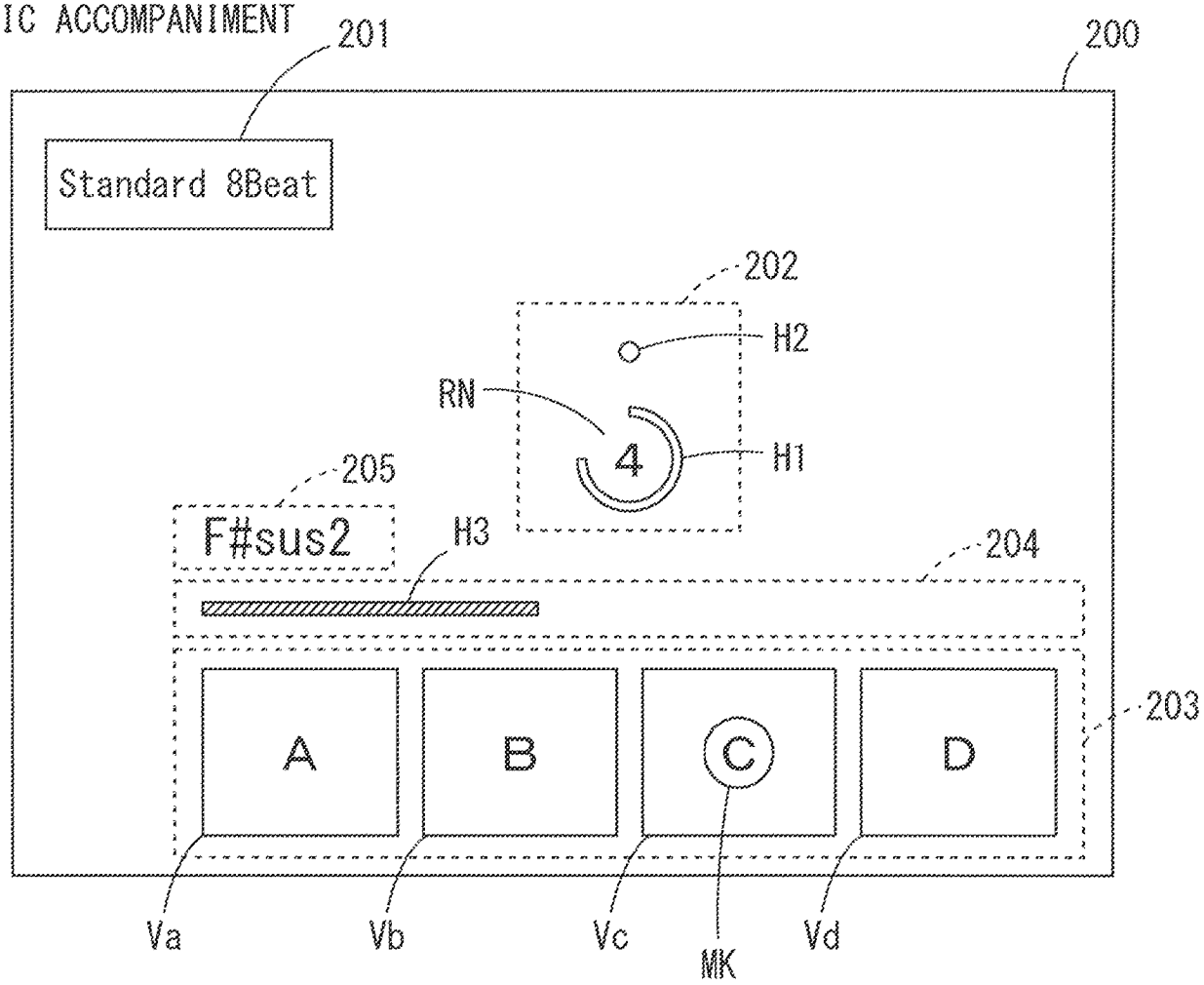
FIG. 4 is a diagram showing one example of an automatic accompaniment screen.

During an automatic accompaniment, an automatic accompaniment screen is displayed on the display 6 of FIG. 1. FIG. 4 is a diagram showing one example of the automatic accompaniment screen displayed on the display 6 of FIG. 1. The automatic accompaniment screen 200 includes an identification information display area 201, an advance notice display area 202, a variation display area 203, a volume display area 204 and a chord display area 205. In the identification information display area 201, identification information for identifying a specified automatic accompaniment data set AD is displayed. In the example of FIG. 4, the name of a category (style) corresponding to a specified automatic accompaniment data set AD is displayed as the identification information.

In the advance notice display area 202, arrival advance notice information, a current position-in-measure and beat position information are displayed. The arrival advance notice information shows time information corresponding to a time required until a current position in a music piece arrives at the next switching position. Here, the time information is not limited to a real time, but includes a time indicating a length in a musical score indicated by the number of measures, the number of beats, ticks or the like.

In the example of FIG. 4, the number of remaining measures RN ("4," specifically) required until the current position arrives at the next switching position is displayed as the arrival advance notice information. For example, when the displayed number of remaining measures RN is "n" (n is a positive integer), a period from the current position to the next switching position is longer than (n−1) measure(s) and not longer than n measure(s). That is, when the number of remaining measures RN is "4," the period from the current position to the next switching position is longer than 3 measures and not longer than 4 measures.

The current position-in-measure shows a relationship between the current position and a starting or ending position of the measure including the current position (hereinafter referred to as a current measure). In the example of FIG. 4, a current position-in-measure is indicated by a partially annular or annular picture H1 arranged to surround the number of remaining measures RN. The shape of the picture H1 changes together with the movement of the current position in the current measure. The change of the shape of the picture H1 will be mentioned below.

The beat position information shows a relationship between the current position and beat positions (what number of beat position the current position corresponds to). In the example of FIG. 4, the beat position information is shown by switching a circular picture H2 between a display state and a non-display state. For example, every time the current position arrives at a beat position, the picture H2 is displayed for a certain period of time (for example, an eighth note). A display period of time of the picture H2 depends on a set tempo.

In the variation display region 203, variation information indicating a variation at the current position is displayed. In the example of FIG. 4, rectangular variation indicators Va, Vb, Vc, Vd respectively corresponding to variations "A" to "D" of a "main" section are displayed so as to be arranged in a lateral direction. Alphabet letters indicating respectively corresponding variations are displayed in the variation indicators Va to Vd. As the variation information, a circular mark MK is displayed to overlap with the alphabet letter indicating the variation at the current position. A color of the entire variation indicator corresponding to a variation selected at a current time point may be changed instead of the display of the mark MK.

In the volume display region 204, volume information indicating a volume of performance detected at a current time point is displayed. In the example of FIG. 4, a volume meter H3 is displayed as the volume information. A position of a right end of the volume meter H3 indicates a volume of the performance at the current time point.

The variation indicators Va to Vd are arranged to correspond to the volume reference in FIG. 3. A relationship between a volume of the performance at the current time point and the volume reference is shown by the variation indicators Va to Vd and the volume meter H3. In the present example, when the right end of the volume meter H3 is positioned above the variation indicator Va, the volume of the performance at the current time point is lower than the threshold value TH1. When the right end of the volume meter H3 is positioned above the variation indicator Vb, the volume of the performance at the current time point is not lower than the threshold value TH1 and lower than the threshold value TH2. When the right end of the volume meter H3 is positioned above the variation indicator Vc, the volume of the performance at the current time point is not lower than the threshold value TH2 and lower than the threshold value TH3. When the right end of the volume meter H3 is positioned above the variation indicator Vd, the volume of the performance at the current time point is not lower than the threshold value TH3. Thus, in a switching position, the variation corresponding to the variation indicator positioned below the right end of the volume meter H3 is selected.

As the volume information, a numeric value indicating the volume of the performance at the current time point may be displayed instead of the volume meter H3, or a graph or the like indicating a change of the volume over time may be displayed. In the chord display region 205, chord information indicating a chord detected from performance data is displayed. In the automatic accompaniment screen, the volume of automatic accompaniment, a set tempo and the like may be displayed, and these may be adjustable appropriately in the automatic accompaniment screen.

[5] Arrival Advance Notice Information and Current Position-in-Measure

Figure 5:
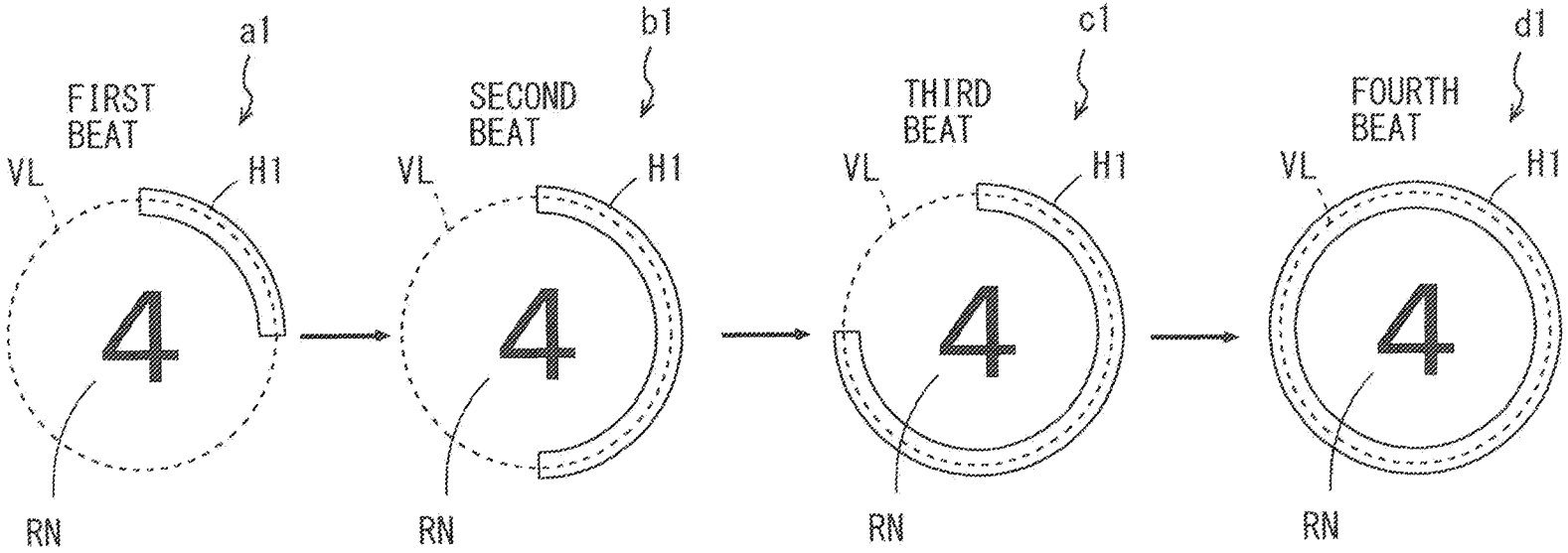
FIG. 5 is a diagram showing a display example of a current position-in-measure.

FIG. 5 is a diagram showing a display example of the current position-in-measure. In FIG. 5, a change of a display state of the current position-in-measure are denoted by symbols a1 to d1. In the example of FIG. 5, a time signature of a music piece is 4/4. In FIG. 5, a circular virtual line VL is indicated by a dotted line to surround the number of remaining measures RN ("4" in the present example) displayed as the arrival advance notice information. In the following description, an upper right portion, a lower right portion, a lower left portion and an upper left portion of the virtual line VL mean an upper right arc portion, a lower right arc portion, a lower left arc portion and an upper left arc portion, respectively, out of four arc portions of the virtual line VL in the case where the virtual line VL is divided into four portions by a horizontal line and a vertical line that are orthogonal to each other.

When the current position arrives at a starting position of a measure (the first beat), the partially annular (1/4 of an annulus) picture H1 extending along the upper right portion of the virtual line VL is displayed (a state a1 in FIG. 5). When the current position arrives at the second beat of the measure, the partially annular (1/2 of the annulus) picture H1 extending along the upper right portion and the lower right portion of the virtual line VL is displayed (a state b1 in FIG. 5). When the current position arrives at the third beat of the measure, the partially annular (3/4 of the annulus) picture H1 extending along the upper right portion, the lower right portion and the lower left portion of the virtual line VL is displayed (a state c1 in FIG. 5). When the current position arrives at the fourth beat of the measure, the annular picture H1 extending along the entire virtual line VL is displayed (a state d1 in FIG. 5).

In this manner, in the example of FIG. 5, every time the current position arrives at a beat position, the shape of the picture H1 displayed as the current position-in-measure changes in steps. The user can view the shape of the picture H1 and easily recognize the current position in a measure. Further, the user can intuitively recognize a tempo of the music piece from a speed of the change of the shape of the picture H1.

Figure 6:
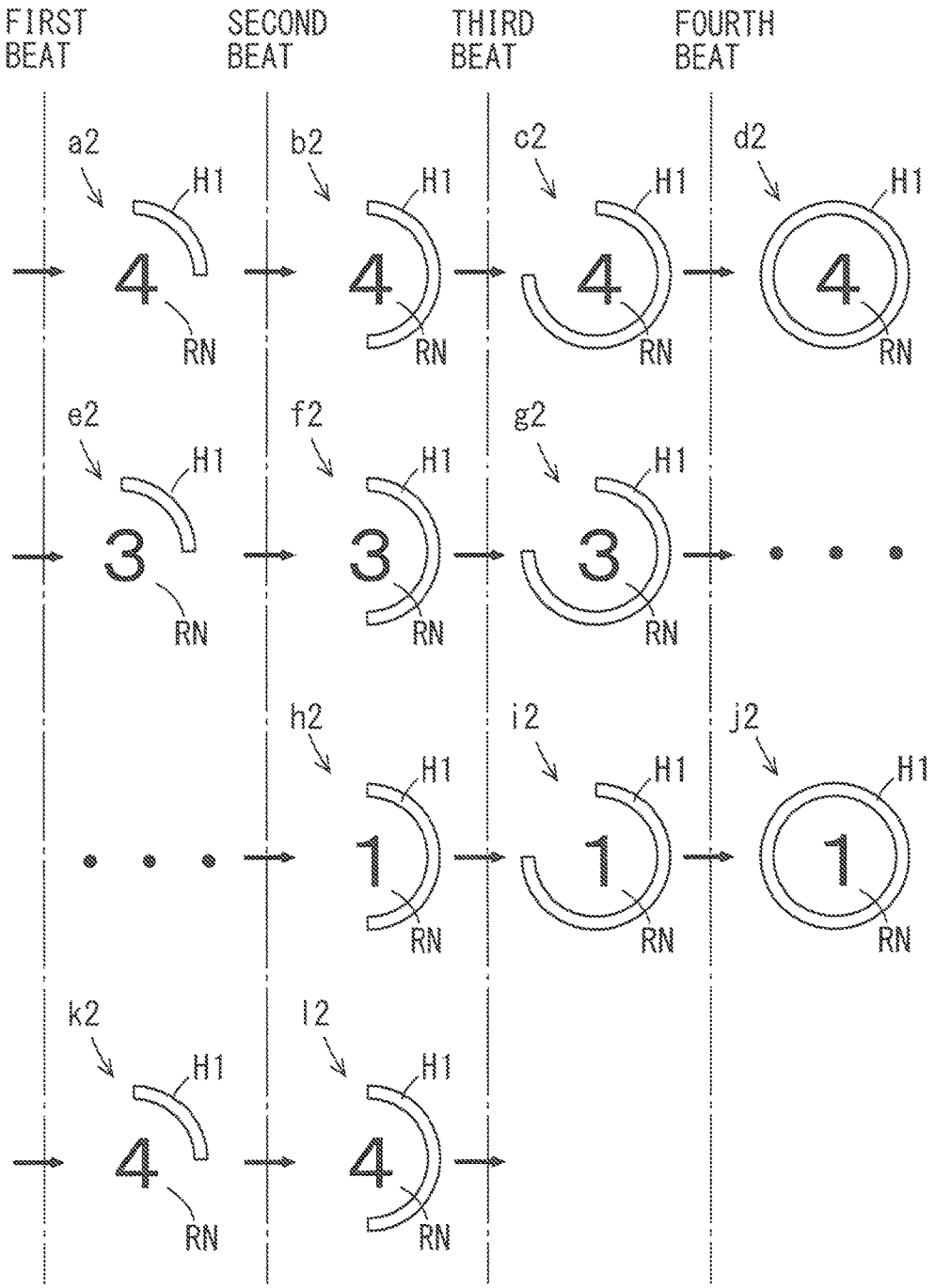
FIG. 6 is a diagram showing a display example of arrival advance notice information and a current position-in-measure.

FIG. 6 is a diagram showing a display example of the arrival advance notice information and the current position-in-measure. In FIG. 6, the changes of the display state of the arrival advance notice information and the current position-in-measure are denoted by symbols a1 to 12. In the example of FIG. 6, a time signature of a music piece is 4/4, and the number of measures between switchings is 4. When a current position arrives at a switching position, "4" is displayed as the number of remaining measures RN (a state a2 in FIG. 6). The shape of the picture H1 displayed as the current position-in-measure changes in steps together with the progress of the current position in the measure (states b2 to d2 in FIG. 6).

When the current position arrives at the ending position of the measure (the starting position of the next measure), the number of remaining measures RN changes to "3" (a state e2 in FIG. 6). In the same manner, the shape of the picture H1 changes in steps according to the progress of the current position in the measure, and the number of remaining measures RN decreases by one every time the current measure moves to the next measure (states f2 to j2 in FIG. 6). When the current position arrives at the switching position, the number of remaining measures RN changes from "1" to "4" which is the number of measures between switchings (a state k2 in FIG. 6). Thereafter, the similar display is repeated between two switching positions.

As the arrival advance notice information, a remaining time (real time), the number of remaining beats or the like may be displayed instead of the number of remaining measures RN. Alternatively, a picture of which a shape changes as the current position approaches an arrival position may be displayed instead of the number of remaining measures RN. Further, as the current position-in-measure, a numeric value indicating the number of past beats or the number of remaining beats in the current measure may be displayed instead of the picture H1. Further, the shape of the picture H1 may change continuously according to the movement of the current position in the current measure, not in steps.

[6] Variation Information

Figure 7A:
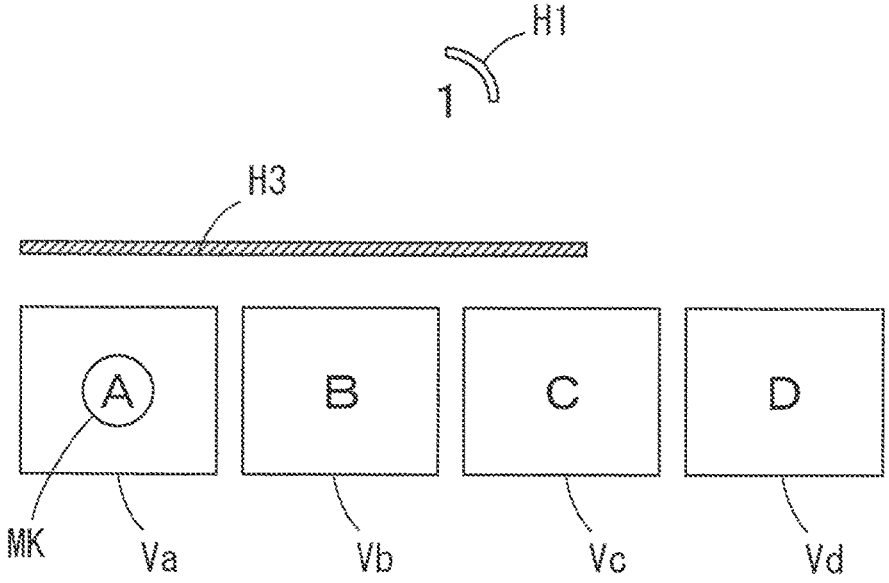
FIGS. 7A and 7B are diagrams for explaining display examples of variation information.
Figure 7B:
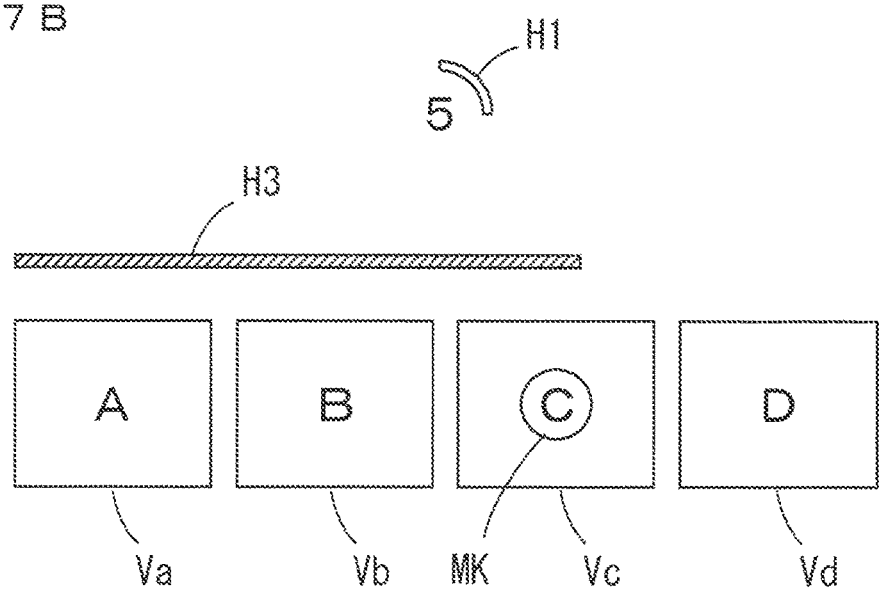

FIGS. 7A and 7B are diagrams for explaining a display example of variation information at the time of switching of variations. In the example of FIGS. 7A and 7B, variations are switched at the switching positions based on the volume at the switching positions. In the example of FIG. 7A, the variation is "A" in the measure right before a switching position. On the other hand, the volume indicated by the volume meter H3 is within the range corresponding to the variation "C" (not lower than the threshold value TH2 and lower than the threshold value TH3 in FIG. 3). When the current position arrives at the switching position with the volume being kept within the range, the variation is switched to "C". Thus, as shown in FIG. 7B, a mark MK is displayed so as to overlap with an alphabet letter "C" in the variation indicator Vc.

The user can recognize the time to the next switching position by the arrival advance notice information, and recognize to which variation the volume at the current time point corresponds by the volume information. Thus, the user can adjust the volume of performance, so that a desired accompaniment element data set is selected at the switching position.

[7] Fill-in Information

Figure 8:
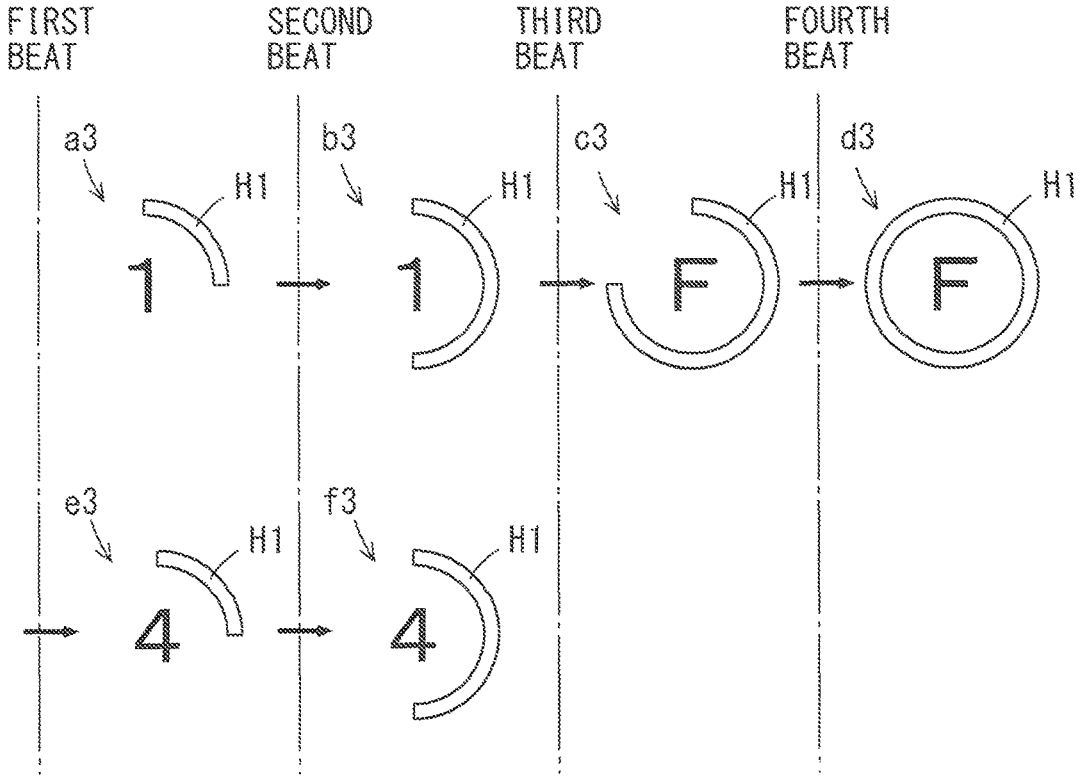
FIG. 8 is a diagram for showing a display example of fill-in information.

In the case where a "fill-in" section is inserted before a switching position, fill-in information indicating that the current position is in the "fill-in" section may be displayed when a fill-in accompaniment element data set is selected. FIG. 8 is a diagram showing a display example of the fill-in information. In FIG. 8, changes of a display state of the fill-in information are denoted by symbols a3 to f3. In the example of FIG. 8, during the "main" section, the "fill-in" section is inserted in the period from two beats before the switching position to the switching position. In this period, the fill-in information is displayed instead of arrival advance notice information.

FIG. 8 shows a display example in the measure right before the switching position. As shown in FIG. 8, in the first beat and the second beat, "1" is displayed as the arrival advance notice information (the number of remaining measures RN) since the current position is in the "main" section (states a3 and b3 in FIG. 8). When the current position arrives at the third beat corresponding to the fill-in starting position, the alphabet letter "F" indicating a fill-in section is displayed as the fill-in information (a state c3 in FIG. 8) instead of arrival advance notice information. When the current position arrives at the next switching position (the ending position of the "fill-in" section), the fill-in information returns to the arrival advance notice information, and then "4" is displayed as the number of remaining measures RN (a state d3 in FIG. 8). Since the fill-in information is displayed in this manner, the user can easily recognize that the current position is in a "fill-in" section. The fill-in information may be displayed in addition to the arrival advance notice information, not instead of the arrival advance notice information.

As described above, at the fill-in starting position, the variation of the next "main" section is provisionally determined. Therefore, the provisionally determined variation may be displayed as the variation information at the fill-in starting position. For example, when the variation of the "main" section before the fill-in starting position is "A," and the variation of the next "main" section that is provisionally determined at the fill-in starting position is "C," the position of the mark MK displayed as the variation information may move from the alphabet letter "A" in the variation indicator Va to the alphabet letter "C" in the variation indicator Vc at the fill-in starting position. Further, display modes of the variation information may be different between the case where an actual variation is displayed and the case where a provisionally determined variation is displayed. For example, the mark MK may be lit when the actual variation is displayed, and the mark MK may be blinked when the provisionally determined variation is displayed.

[8] Functional Configuration

Figure 9:
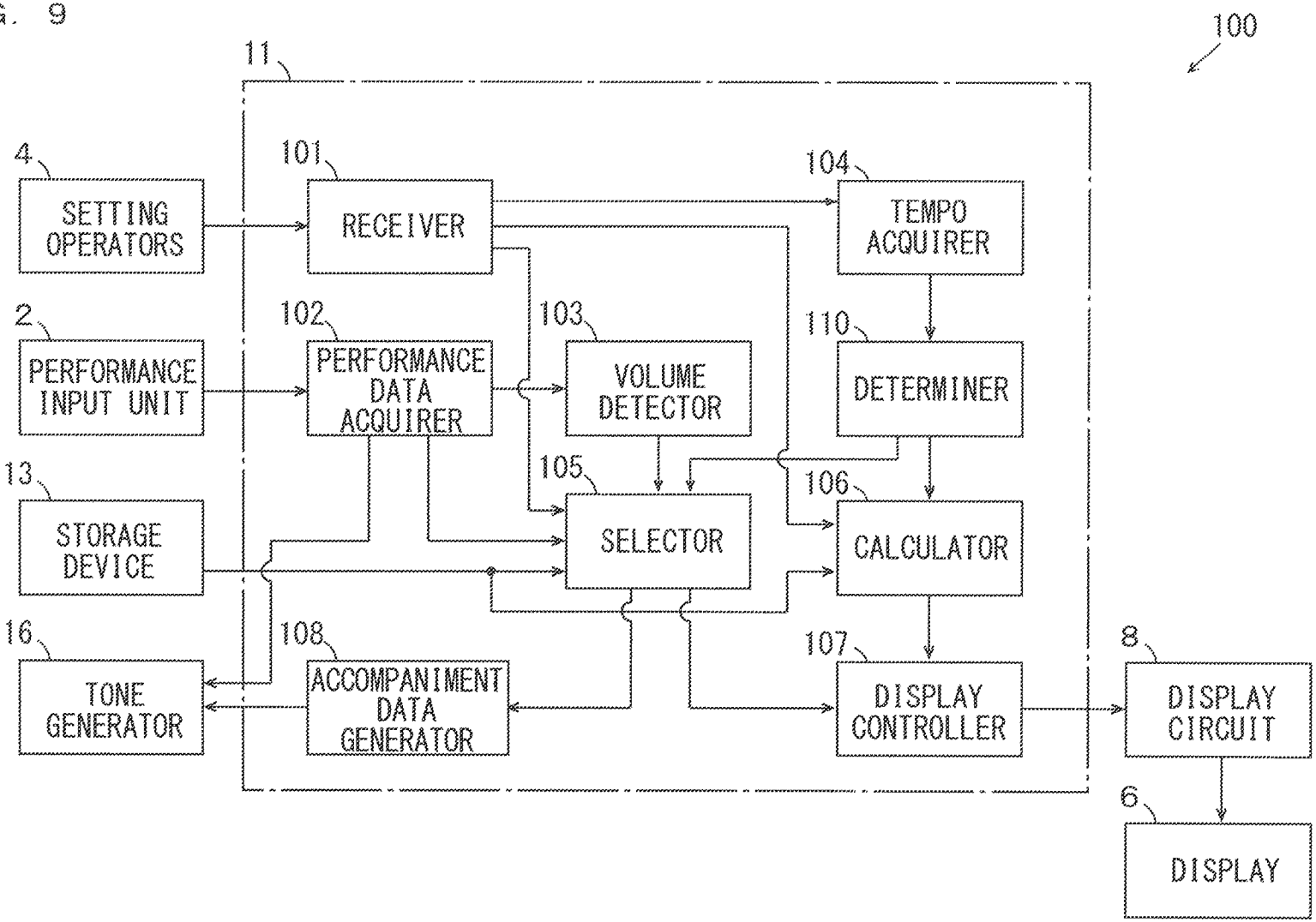
FIG. 9 is a block diagram showing a functional configuration of the automatic accompaniment apparatus.

FIG. 9 is a block diagram showing a functional configuration of the automatic accompaniment apparatus 100 according to the embodiment of present invention. The CPU 11 of FIG. 1 executes the automatic accompaniment program stored in the ROM 10 or the storage device 13, whereby functions of respective blocks in the automatic accompaniment apparatus 100 of FIG. 9 are implemented. As shown in FIG. 9, the automatic accompaniment apparatus 100 includes a receiver 101, a performance data acquirer 102, a volume detector 103, a tempo acquirer 104, a determiner 110, a selector 105, a calculator 106, a display controller 107 and an accompaniment data generator 108.

The receiver 101 receives specification of a music piece structure data set and specification of an automatic accompaniment data set AD. Also, the receiver 101 receives input of basic information and other various instructions. The basic information includes the number of measures between switchings, and insertion or non-insertion of a "fill-in" section, for example. The number of measures between switchings may be optionally specified, or one of a plurality of predetermined candidates (for example, four measures and eight measures) may be selected.

The performance data acquirer 102 acquires the performance data input by the user's operation of the performance input unit 2. The acquired performance data is supplied to the tone generator 16, so that a performance sound corresponding to the user's performance is generated. The volume detector 103 detects the volume of the user's performance based on the acquired performance data. For example, the volume detector 103 calculates an integrated value or an average value of the velocity within a certain time in the performance data, and detects the calculated value as the volume. The velocity means a volume of each performance sound in the MIDI standard. Noise removal processing, smoothing, correction depending on the strength of hit of a key by the user or the like may be performed on the calculated value.

The tempo acquirer 104 acquires a tempo of a music piece. The acquired tempo of the music piece corresponds to a tempo of the user's performance and a reproduction tempo of the automatic accompaniment. The user can change the reproduction tempo by operating the setting operators 4. For example, the receiver 101 receives the input of the tempo as the basic information, and the tempo acquirer 104 acquires the input tempo. Alternatively, when a recommendation tempo is set in correspondence with the specified music piece structure data set, the tempo acquirer 104 may acquire the recommendation tempo. Furthermore, the tempo acquirer 104 may acquire the performance tempo based on the performance data acquired by the performance data acquirer 102. The determiner 110 determines the current position in a music piece in progress based on the tempo acquired by the tempo acquirer 104 and the clock information supplied from the timer 12 in FIG. 1. The selector 105 selects an accompaniment element data set to be used from the plurality of accompaniment element data sets every time a current position in the music piece in progress arrives at a switching position. In the present example, every time the current position arrives at the starting position of a "main"

section, the selector 105 selects a main accompaniment element data set to be used from the plurality of main accompaniment element data sets based on the detected volume. Further, every time the current position arrives at the fill-in starting position, the selector 105 selects a fill-in accompaniment element data set to be used from the plurality of fill-in accompaniment element data sets according to the variations of the "main" sections before and after the selected fill-in accompaniment element data set.

The calculator 106 calculates time information corresponding to a time required until the current position arrives at the next switching position based on the acquired tempo. In the present example, the calculator 106 calculates the number of measures remaining until the current position arrives at the next main switching position as the time information. The display controller 107 displays the arrival advance notice information corresponding to the calculated time information on the display 6 by controlling the display circuit 8. In the present example, the display controller 107 displays the calculated number of remaining measures as the arrival advance notice information. Also, the display controller 107 further displays a current position-in-measure indicating the relationship between the current position and the starting or ending position of the current measure, and the variation information indicating the variation selected at the current position on the display 6 by controlling the display circuit 8.

The accompaniment data generator 108 generates accompaniment data indicating the automatic accompaniment based on the selected accompaniment element data set. Specifically, the accompaniment data generator 108 detects a chord based on the performance data, and generates accompaniment data by converting pitches of the note sequence included in the accompaniment pattern data to be adapted to the detected chord. A chord is a combination of a root and a type. The generated accompaniment data is supplied to the tone generator 16, so that an automatic accompaniment sound is generated. Note that an automatic accompaniment sound corresponding to a predetermined chord or the lastly detected chord may be output even when the user is not performing music. The accompaniment data may be generated based on the previously acquired performance data, not limited to the performance data which is acquired in real time together with the user's performance.

[9] Automatic Accompaniment Processing

Figure 10:
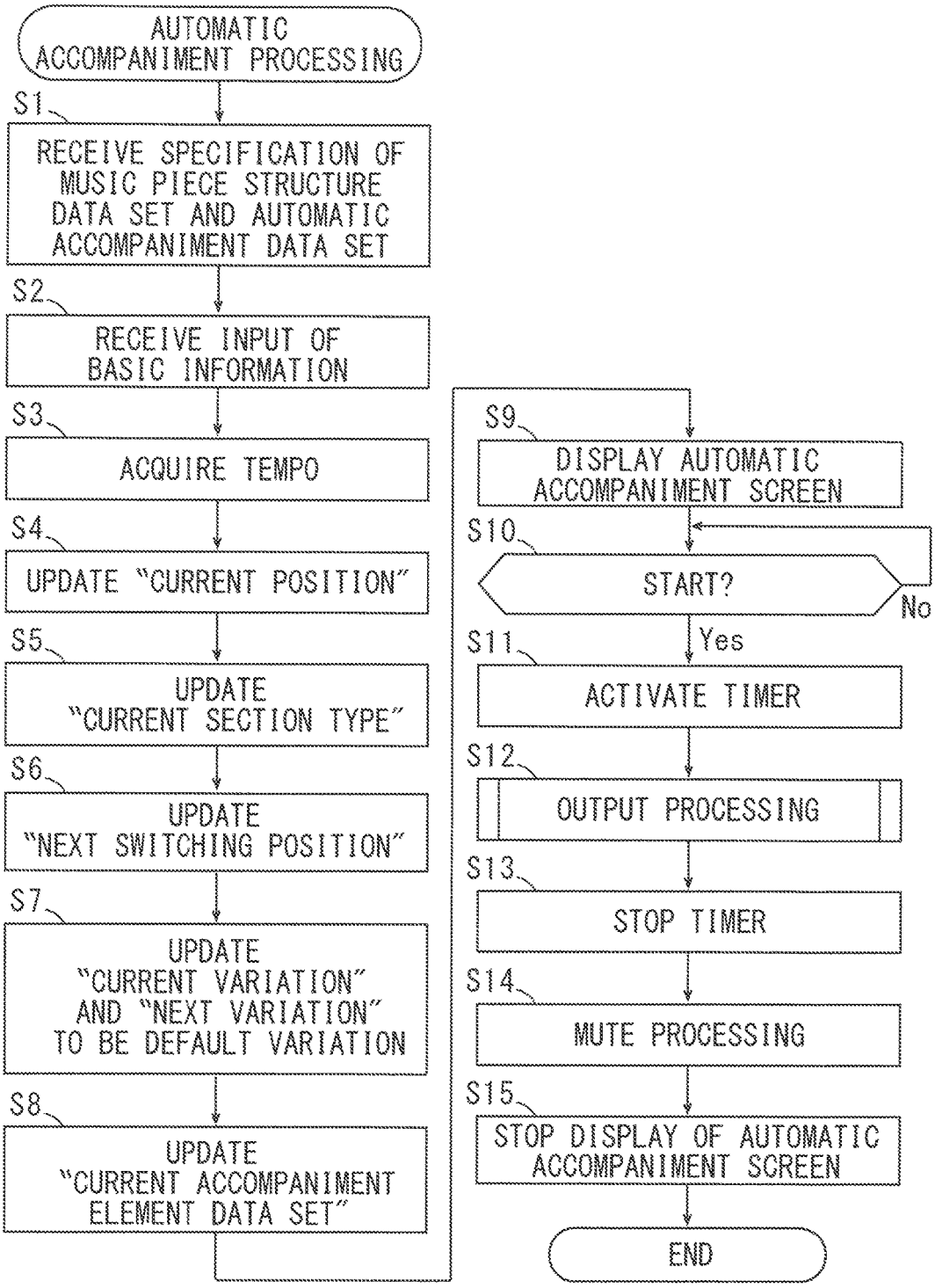
FIG. 10 is a flow chart showing one example of automatic accompaniment processing.

FIG. 10 is a flow chart showing one example of the automatic accompaniment processing by the functional blocks of FIG. 9. The CPU 11 of FIG. 1 executes the automatic accompaniment program stored in the ROM 10 or the storage device 13 to perform the automatic accompaniment processing of FIG. 10. In the present example, in the RAM 9 or the storage device 13 of FIG. 1, a storage region for a "current position" and a "next switching position" is secured, and a storage region for a "current section type" indicating a basic section type in the current position, a storage region for a "current variation" indicating the basic variation in the current position, a storage region for the "next variation" indicating a variation to be selected in the next switching position, and a storage region for a "current accompaniment element data set" indicating an accompaniment element data set selected in the current position are secured, respectively. At the start of the automatic accompaniment processing, these pieces of information are kept in the state at the end of the previous automatic accompaniment processing, for example.

Further, the user operates the setting operators 4 of FIG. 1 to specify a music piece structure data set and an automatic accompaniment data set AD and input the basic information. The receiver 101 receives the specification of the music piece structure data set and the automatic accompaniment data set AD (step S1) and receives the input of the basic information (step S2). A default music piece structure data set, a default automatic accompaniment data set AD and default basic information may be prepared in advance.

Next, the tempo acquirer 104 acquires a tempo of a music piece (a tempo of a user's performance and a tempo of reproduction of the automatic accompaniment) (step S3). Then, the selector 105 updates a "current position" (step S4). For example, the "current position" is updated to be the head position of the music piece. The user can optionally change the "current position" by operating the setting operators 4 of FIG. 2. Next, the selector 105 updates the "current section type" based on the specified music piece structure data set and the "current position" (step S5).

Next, the selector 105 updates the "next switching position" based on the "current position" and the number of measures between switchings that has been input as the basic information (step S6). Then, the selector 105 respectively updates the "current variation" and the "next variation" to be a default variation (step S7). The default variation is "A," for example. Next, the selector 105 updates the "current accompaniment element data set" to be the accompaniment element data set corresponding to the "current section type" and the "current variation" (step S8).

Then, the display controller 107 displays the automatic accompaniment screen on the display 6 (step S9). In this case, the arrival advance notice information is displayed based on the "current position" and the "next switching position," the current position-in-measure is displayed based on the "current position," and the variation information is displayed based on the "current variation" (the default variation at this time point).

Then, the receiver 101 determines whether an instruction for starting the automatic accompaniment has been given (step S10). For example, the setting operators 4 of FIG. 1 include a start button. When the start button is depressed, the receiver 101 determines that the CPU 11 has been instructed to start the automatic accompaniment. Further, the receiver 101 may determine that the CPU 11 has been instructed to start the automatic accompaniment when the user's performance is started.

The receiver 101 repeats the step S10 until the instruction for starting the automatic accompaniment is given. The accompaniment data generator 108 starts the timer 12 of FIG. 1 (step S11). Then, the volume detector 103, the selector 105, the display controller 107 and the accompaniment data generator 108 mainly perform output processing (step S12). The output processing will be mentioned below. When the output processing ends, the accompaniment data generator 108 stops the timer 12 (step S13) and performs mute processing of stopping the generation of a sound (step S14). Further, the display controller 107 stops the display of the automatic accompaniment screen (step S15). Thus, the automatic accompaniment processing ends.

Figure 11:
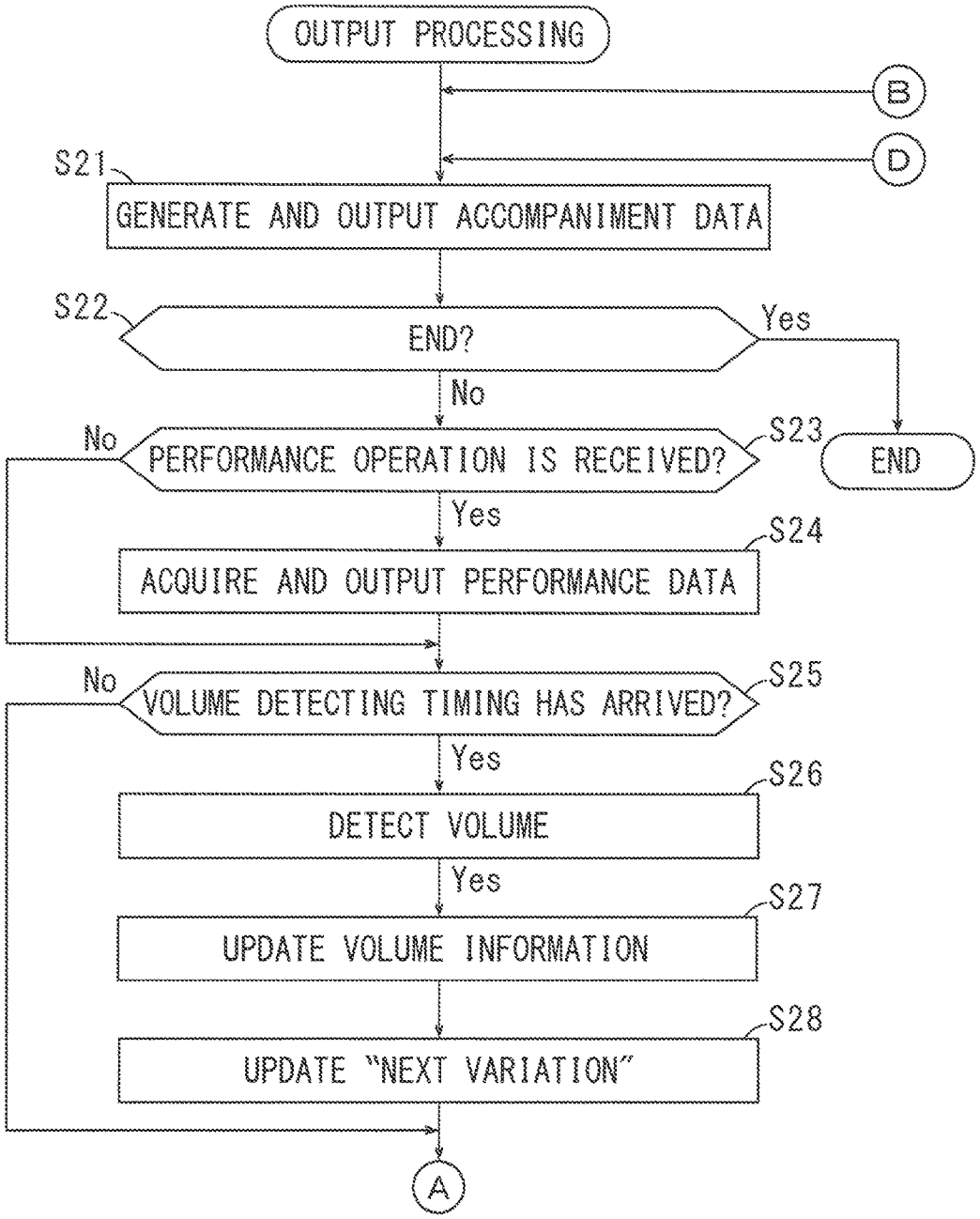
FIGS. 11, 12 and 13 are flow charts showing one example of output processing.
Figure 12:
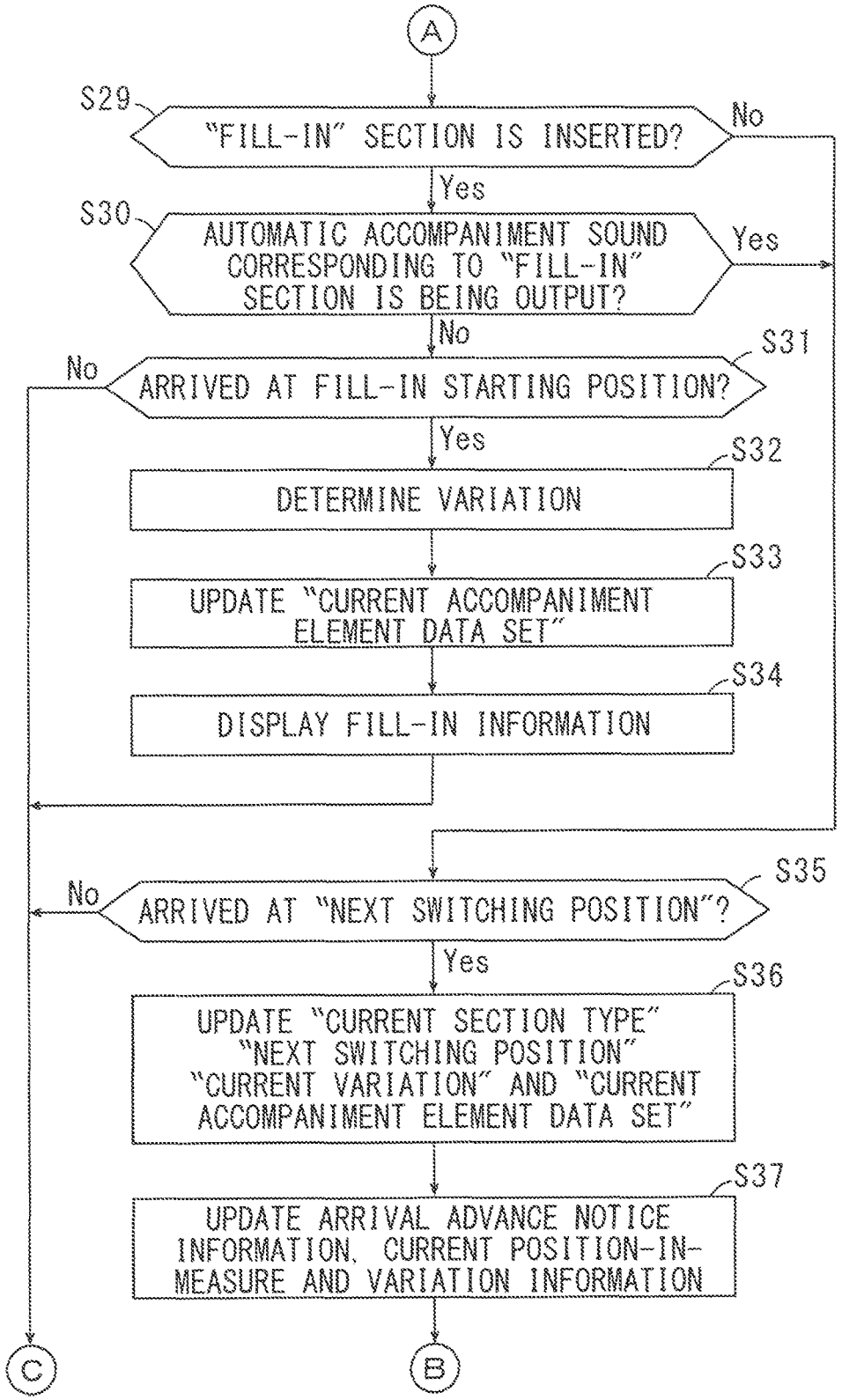
Figure 13:
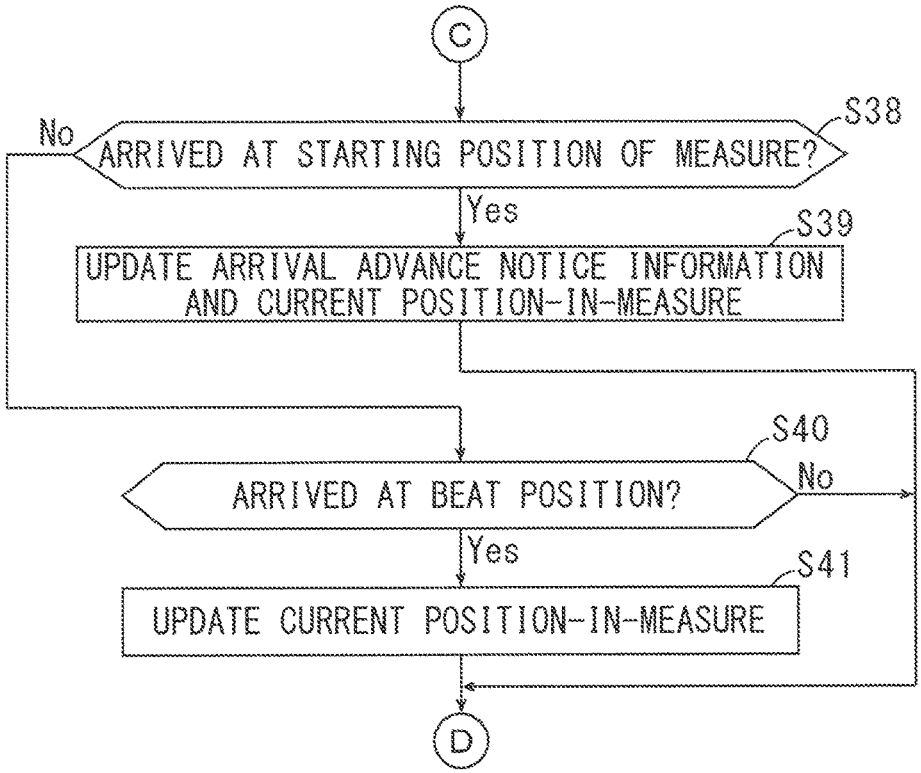

FIGS. 11, 12 and 13 are flow charts showing one example of the output processing. During the output processing, the "current position" is sequentially updated together with progress of the music piece. As shown in FIG. 11, the accompaniment data generator 108 first generates and outputs accompaniment data based on the "current accompaniment element data set" (step S21). Thus, the sound system 18 generates an automatic accompaniment sound. Then, the receiver 101 determines whether an instruction for ending the automatic accompaniment has been given (step S22). For example, the setting operators 4 of FIG. 1 include an end button. When the end button is depressed, the receiver 101 determines that the instruction for ending the automatic accompaniment has been given. Further, when the "current position" arrives at the ending position of the music piece, the receiver 101 may determine that the instruction for ending the automatic accompaniment has been given.

When the instruction for ending the automatic accompaniment has not been given, the performance data acquirer 102 determines whether a performance operation by the user has been received (step S23). When the user operates the performance input unit 2 of FIG. 1, the performance operation is received. When the performance operation has not been received, the next step S24 is skipped. When the performance operation has been received, the performance data acquirer 102 acquires performance data based on the received performance operation and outputs the performance data (step S24). Thus, the sound system 18 of FIG. 1 generates a sound of the user's performance. Next, the volume detector 103 determines whether volume detecting timing has arrived (step S25). For example, a volume detection cycle is previously input as the basic information. After an instruction for starting the step S10 is given, the volume detecting timing arrives at the previously input detection cycle.

When the volume detecting timing has not arrived, the following steps S26, S27 and S28 are skipped. When the volume detecting timing has arrived, the volume detector 103 detects a volume of the user's performance at the volume detecting timing (step S26). Next, the display controller 107 updates the volume information in the automatic accompaniment screen based on the detected volume (step S27). Next, the selector 105 provisionally determines a basic variation to be selected at the next switching position based on the detected volume and the preset volume reference, and updates the "next variation" to be the determined basic variation (step S28).

Then, the selector 105 determines whether a "fill-in" section is to be inserted based on the previously input basic information (step S29 of FIG. 12). When the "fill-in" section is to be inserted, the selector 105 determines whether the automatic performance sound corresponding to the "fill-in" section is being output at the time point (step S30).

When the automatic accompaniment sound corresponding to the "fill-in" is not being output, the selector 105 determines whether the "current position" has arrived at the fill-in starting position (step S31). When the "current position" has not arrived at the fill-in starting position, the display controller 107 proceeds to the step S38 mentioned below. When the "current position" has arrived at the fill-in starting position, the selector 105 determines the variation of the "fill-in" section to be inserted based on the "current variation" and the "next variation" (step S32). For example, when the "current variation" is "A," and the "next variation" is "C," the variation of the "fill-in" section to be inserted is "AC."

Then, the selector 105 selects the fill-in accompaniment element data set corresponding to the determined variation and updates the "current accompaniment element data set" to be the selected fill-in accompaniment element data set (step S33). Then, the display controller 107 displays fill-in information on the automatic accompaniment screen (step S34), and proceeds to the step S38 mentioned below.

When the "fill-in" section is not inserted in the step S29, or when the automatic accompaniment sound corresponding to the "fill-in" section is being output in the step S30, the selector 105 determines whether the "current position" has arrived at the "next switching position" (step S35). When the "current position" has not arrived at the "next switching position," the selector 105 proceeds to the step S38 mentioned below.

When the "current position" has arrived at the "next switching position," the selector 105 updates the "current section type," the "next switching position," the "current variation" and the "current accompaniment element data set" (step S36). Specifically, the "current section type" is updated to be the type of the section including the switching position at which the current position has arrived as the starting position, the "next switching position" is updated to be the switching position next to the switching position at which the current position has arrived, the "current variation" is updated to be the variation stored as the "next variation." Further, the accompaniment element data set corresponding to the updated "current variation" is selected, and the "current accompaniment element data set" is updated to be the selected accompaniment element data set.

Next, the display controller 107 respectively updates the arrival advance notice information, the current position-in-measure and the variation information in the automatic accompaniment screen (step S37), and returns to the step S21. Specifically, the arrival advance notice information is updated so as to indicate the number of measures between switchings, the current position-in-measure is updated so as to indicate the starting position of a measure, and the variation information is updated so as to indicate the updated "current variation."

In the step S38 in FIG. 13, the display controller 107 determines whether the "current position" has arrived at the starting position of the measure. When the "current position" has arrived at the starting position of the measure, the display controller 107 updates the arrival advance notice information and the current position-in-measure in the automatic accompaniment screen (step S39), and the accompaniment data generator 108 returns to the step S21 of FIG. 11. Specifically, the arrival advance notice information is updated so as to indicate the number of remaining measures that is calculated by the calculator 106, and the current position-in-measure is updated so as to indicate the starting position of the measure.

When the "current position" has not arrived at the starting position of the measure in the step S38, the display controller 107 determines whether the "current position" has arrived at a beat position in the measure (step S40). When the "current position" has arrived at the beat position in the measure, the display controller 107 updates the current position-in-measure (step S41). Specifically, the current position-in-measure is updated so as to indicate the current beat position in the measure. Thereafter, the accompaniment data generator 108 returns to the step S21 in FIG. 11.

In this manner, the "current accompaniment element data set" is updated every time the fill-in insertion timing arrives, and is updated every time the "next switching position" arrives (steps S33 and S37). The accompaniment data is continuously generated and output based on the updated "current accompaniment element data set," whereby an automatic accompaniment sound is continuously output together with the user's performance.

Further, in the steps S27, S33, S36, S39 and S41, the arrival advance notice information, the current position-in-measure, the variation information, the volume information and the fill-in information in the automatic accompaniment screen are updated appropriately in real time. Thus, the user can easily and accurately recognize the time required until the current position arrives at the next switching position, the movement of the current position in the measure, the selected variation and so on.

[10] Effects

In the automatic accompaniment apparatus 100 according to the present embodiment, because the accompaniment element data set to be used at the predetermined switching position is selected, the accompaniment element data set that is actually used is prevented from being changed at an unnatural position in the music piece. Thus, the automatic accompaniment can be prevented from changing unnaturally. In addition, the arrival advance notice information corresponding to the time required until the current position arrives at the next switching position is displayed, so that the user can perform music while being conscious of the next switching position. Even when the accompaniment element data set to be used is switched at the switching position, because the user is conscious of the switching position being close, the user's performance is unlikely to be disturbed. Therefore, an occurrence of a mistake of performance due to the change of the automatic accompaniment can be prevented.

Further, in the present embodiment, the accompaniment element data set to be used is selected based on the volume of the user's performance. Thus, the user can adjust the volume of the performance such that a desired accompaniment element data set is selected at the switching position while being conscious of the switching position. Further, in the present embodiment, the volume information indicating the detected volume of the user's performance is displayed. In this case, the user can adjust the volume (strength and weakness) of the performance appropriately such that a desired accompaniment element data set is selected at the switching position.

Further, in the present embodiment, the main accompaniment element data set is selected at the starting position of the main section, the fill-in accompaniment element data set is selected at the starting position of the fill-in section at which the current position arrives right before arriving at the ending position of the main section, and then the main accompaniment element data set of the next main section is selected. This prevents the automatic accompaniment from changing unnaturally, and prevents the automatic accompaniment from being monotonous. In addition, the fill-in information is displayed when the fill-in accompaniment element data set is selected, whereby the user can recognize that the current position is in the fill-in section. This prevents the user's performance from being disturbed by insertion of the fill-in section.

Also, in the present embodiment, the current position-in-measure indicating the relationship between the current position and the starting or ending position of the measure including the current position is further displayed. In this case, the user can recognize the change of the current position in each measure, thereby more easily recognizing the time required until the current position arrives at the next switching position.

[11] Other Embodiments (a) While the current position is determined based on a tempo, and the time information is calculated based on a tempo in the above-mentioned embodiment, determination of the current position and calculation of the time information may be carried out without use of a tempo.

Figure 14:
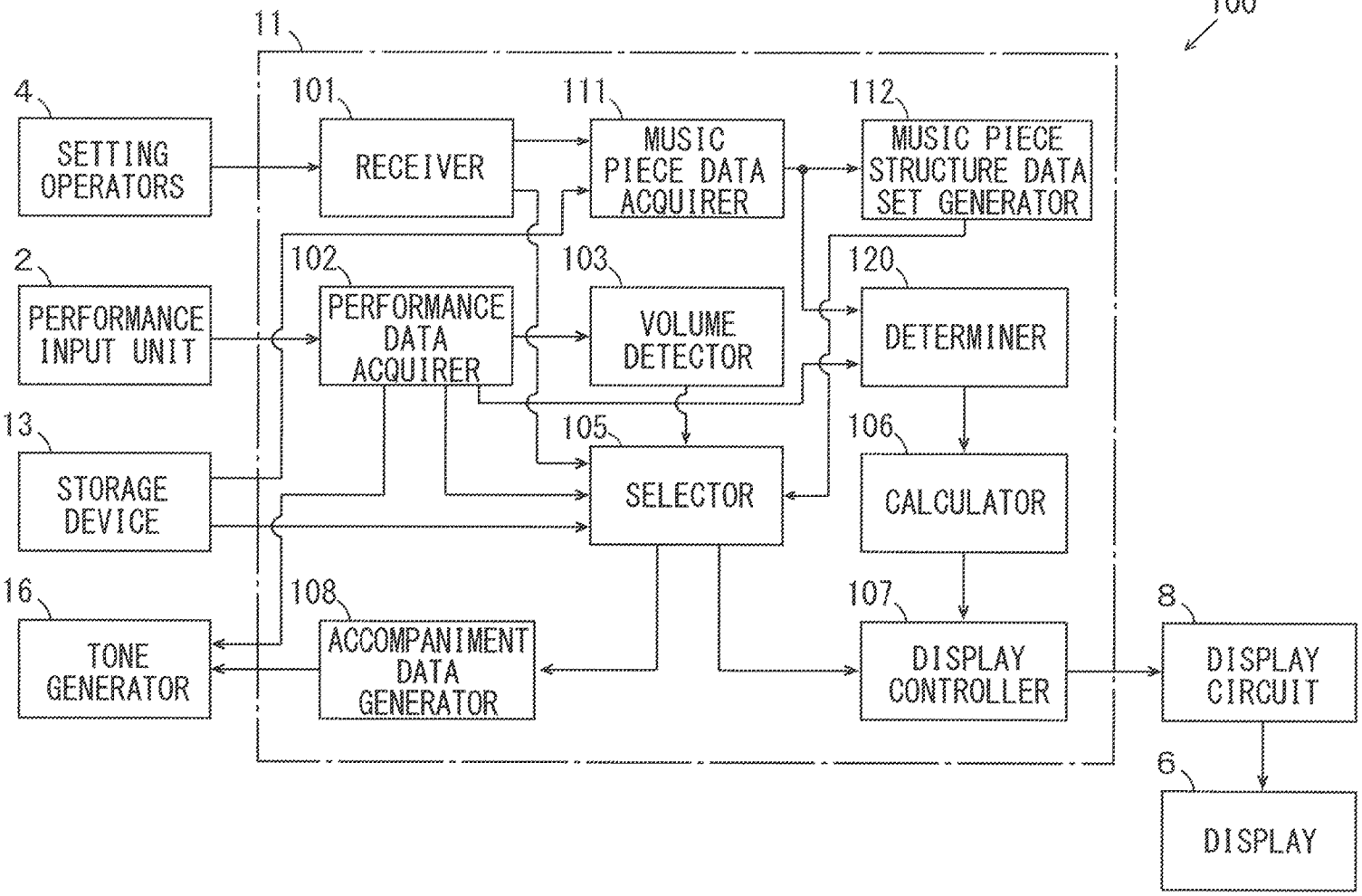
FIG. 14 is a block diagram showing a functional configuration of an automatic accompaniment apparatus according to another embodiment.

FIG. 14 is a block diagram showing a functional configuration of an automatic accompaniment apparatus according to another embodiment. The automatic accompaniment apparatus 100 of FIG. 14 is different from the automatic accompaniment apparatus 100 of FIG. 9 in that a music piece data acquirer 111, a music piece structure data generator 112 and a determiner 120 are included instead of the tempo acquirer 104 and the determiner 110 of FIG. 9.

The storage device 13 stores music piece data corresponding to one or a plurality of music pieces. When the receiver 101 receives specification of music piece data, the music piece acquirer 111 acquires the specified music piece data from the storage device 13. The music piece structure data generator 112 generates a music piece structure data set based on the music piece data acquired by the music piece data acquirer 111. In the case where a music piece structure data set corresponding to the acquired music piece data is stored in advance, the music piece structure data generator 112 may acquire music piece structure data set without newly generating a music piece structure data set. The determiner 120 determines a current position based on the music piece data acquired by the music piece data acquirer 111 and the performance data acquired by the performance data acquirer 102.

Figure 15:
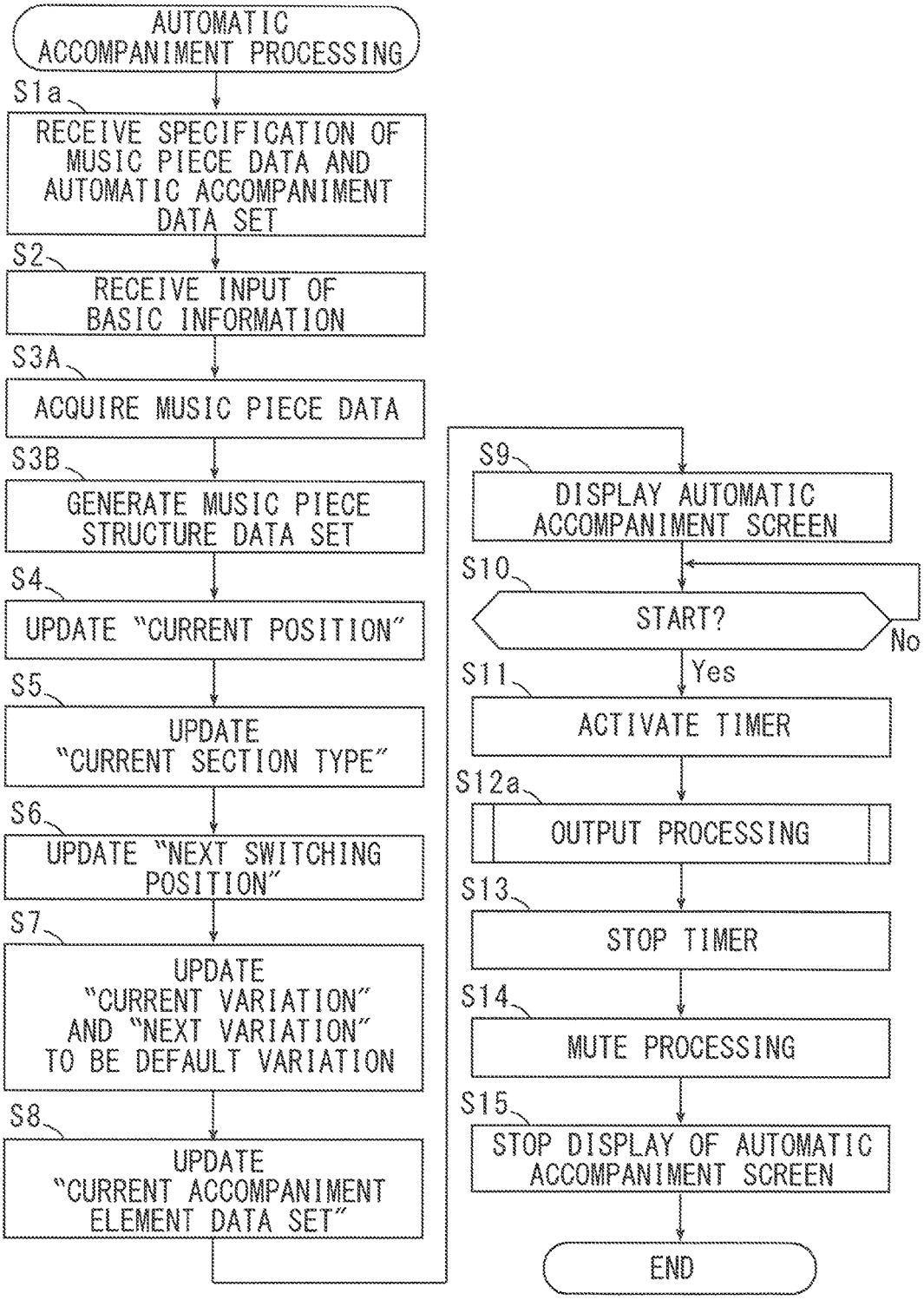
FIG. 15 is a flow chart showing one example of automatic accompaniment processing by functional blocks of FIG. 14.

FIG. 15 is a flow chart showing one example of automatic accompaniment processing by the functional blocks of FIG. 14. The automatic accompaniment processing of FIG. 15 is different from the automatic accompaniment processing of FIG. 9 in that the step S1*a* is included instead of the step S1 of FIG. 9, the steps S3A and S3B are included instead of the step S3 of FIG. 9, and the step S12*a* is included instead of the step S12 of FIG. 9.

In the present example, the user operates the setting operators 4 of FIG. 1 to specify music piece data and an automatic accompaniment data set AD and input the basic information. The receiver 101 receives the specification of the music piece data and the automatic accompaniment data set AD (step S1), and receives the input of the basic information (step S2). The music piece data acquirer 111 acquires the specified music piece data (step S3A). The music piece structure data generator 112 generates a music piece structure data set based on the acquired music piece data (step S3B).

Figure 16:
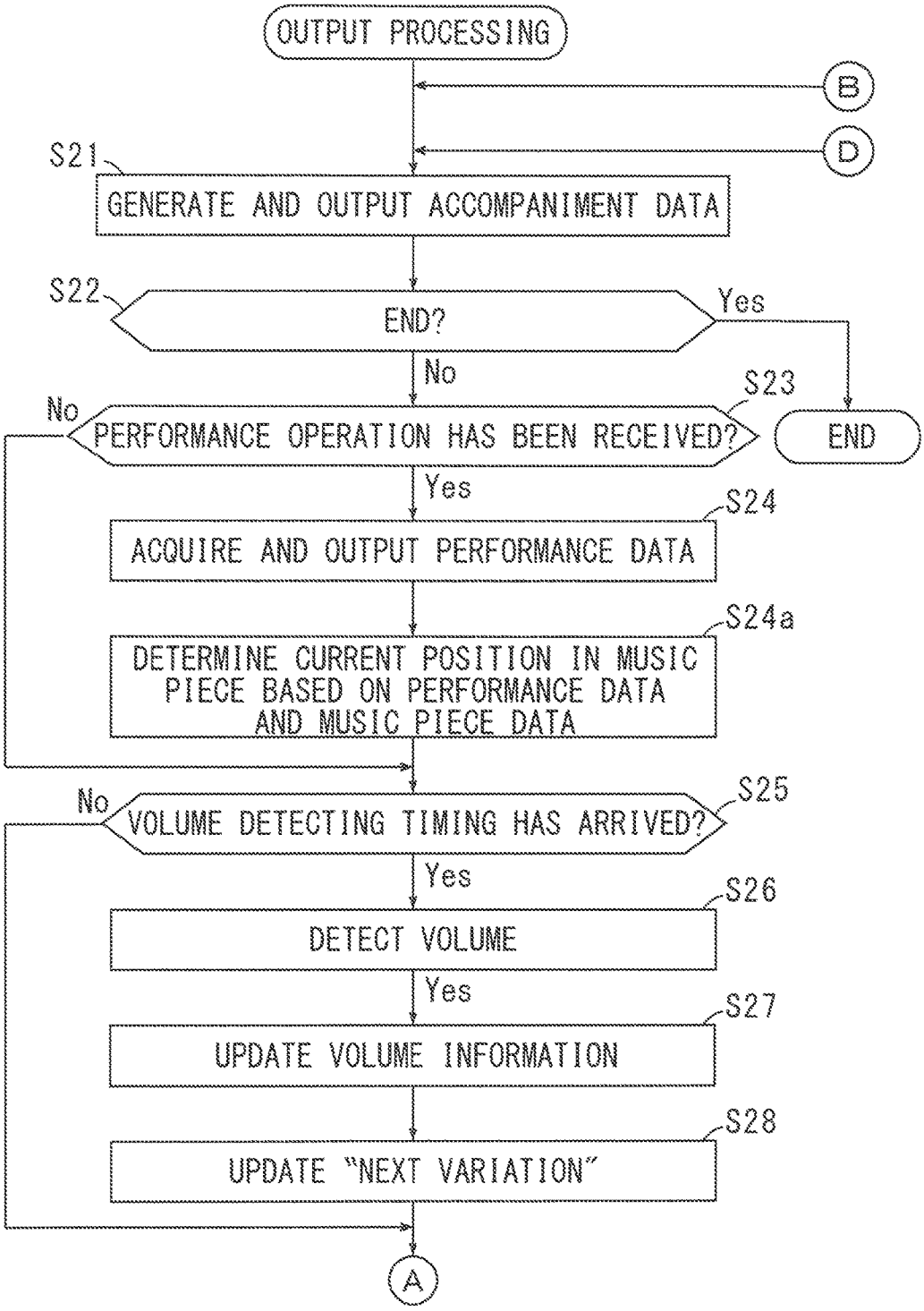
FIG. 16 is a flow chart showing part of output processing of the step in FIG. 15.

FIG. 16 is a flow chart showing part of the output processing of the step S12*a* in FIG. 15. The output processing of the step S12*a* further includes the step S24*a* between the step S24 and the step S25 as shown in FIG. 16.

The performance data acquirer 102 acquires performance data based on a performance operation and outputs the performance data (step S24), and then the determiner 120 determines the current position in the music piece being performed based on the performance data and the music piece data (step S24*a*). The other steps S21 to S28 and the steps S29 to S41 (FIGS. 12 and 13) except for the step S24*a* of the output processing 512*a* are the same as the output processing in the step S12 of FIG. 10.

In the present example, the current position can be determined based on the performance data and the music piece data without use of a tempo, and the time information can be calculated without use of a tempo.

(b) While the switching positions are set every predetermined number of measures between switchings in the above mentioned embodiment, switching positions may be set under other conditions. For example, a starting position or an ending position of each section indicated by a music piece structure data set may be set as a switching position. Alternatively, in the case where an electronic musical score is used, positions such as rehearsal marks and bar lines may be detected from the electronic musical score, and switching positions may be set based on the detected positions. Further, intervals between switching positions do not have to be constant, and switching positions may be set at various intervals such as every two measures, four measures and eight measures in the same music piece.

(c) While an accompaniment element data set is selected based on the volume of performance and the predetermined volume reference in the above mentioned embodiment, an accompaniment element data set may be selected under other conditions. For example, a plurality of volume references may be prepared, and an accompaniment element data set may be selected based on a volume reference selected by the user out of the plurality of volume references. Further, the user may be able to optionally change each threshold value of the volume reference. Alternatively, a variation to be selected every switching position may be predetermined, and an accompaniment element data set corresponding to the predetermined variation may be selected.

(d) While each functional block of FIG. 9 is implemented by hardware such as the CPU 11 and software such as the automatic accompaniment program in the above mentioned embodiment, these function blocks may be implemented by hardware such as an electronic circuit.

(e) While the present invention is applied to the electronic musical apparatus 1 including the display 6 in the above mentioned embodiment, the present invention may be applied to an electronic musical instrument that is connectable to an external display device such as a smartphone or a tablet terminal. In that case, an automatic accompaniment screen including arrival advance notice information and the like is displayed on the screen of the external display device. Further, the automatic accompaniment apparatus 100 may be applied to another electronic equipment such as a personal computer or a smartphone.

While preferred embodiments of the present invention have been described above, it is to be understood that variations and modifications will be apparent to those skilled in the art without departing the scope and spirit of the present invention. The scope of the present invention, therefore, is to be determined solely by the following claims.

We claim:

1. An automatic accompaniment apparatus comprising:

a determiner that determines a current position in a music piece in progress;

a selector that selects an accompaniment element data set to be used out of a plurality of accompaniment element data sets every time the determined current position arrives at a predetermined switching position;

an accompaniment data generator that generates accompaniment data indicating automatic accompaniment based on the selected accompaniment element data set;

a calculator that calculates time information corresponding to a time required until the determined current position arrives at a next switching position; and a display controller that controls a display to display arrival advance notice information indicating the calculated time information, wherein the displayed arrival advance notice information changes according to the calculated time information as the current position approaches the next switching position.

2. The automatic accompaniment apparatus according to claim 1, further comprising:

a tempo acquirer that acquires a tempo of the music piece, wherein the determiner calculates the current position based on the acquired tempo.

3. The automatic accompaniment apparatus according to claim 1, further comprising:

a performance data acquirer that acquires performance data indicating a user's performance, wherein the determiner calculates the current position based on music piece data indicating the music piece and the acquired performance data.

4. The automatic accompaniment apparatus according to claim 1, wherein:

the plurality of accompaniment element data sets include:

a plurality of main accompaniment element data sets to be used in each of a plurality of main sections which are body portions of the music piece; and a plurality of fill-in accompaniment element data sets to be used in a fill-in section which is disposed between at least two main sections, the switching position is a starting position of each main section, a starting position of the fill-in section is set at a position at a predetermined period before the switching position, the selector selects:

a main accompaniment element data set to be used out of the plurality of main accompaniment element data sets every time the current position arrives at the switching position; and a fill-in accompaniment element data set to be used out of the plurality of fill-in accompaniment element data sets every time the current position arrives at the starting position of the fill-in section, and the display controller controls the display to further display fill-in information indicating that the current position is in the fill-in section when the fill-in accompaniment element data set is selected by the selector.

5. The automatic accompaniment apparatus according to claim 1, wherein the display controller controls the display to further display a current position-in-measure indicating a relationship between the current position and a starting or ending position of a measure including the current position.

6. The automatic accompaniment apparatus according to claim 1, further comprising:

a performance data acquirer that acquires performance data indicating a user's performance; and a volume detector that detects a volume of the user's performance based on the acquired performance data, wherein the selector selects an accompaniment element data set to be used based on the detected volume.

7. The automatic accompaniment apparatus according to claim 6, wherein the display controller controls the display to further display volume information indicating the detected volume.

8. The automatic accompaniment apparatus according to claim 1, wherein the time information includes a real time.

9. The automatic accompaniment apparatus according to claim 1, wherein the time information includes a length in a musical score.

10. The automatic accompaniment apparatus according to claim 1, wherein:

each accompaniment element data set includes accompaniment pattern data, and the accompaniment data generator generates the accompaniment data corresponding to the current position based on the selected accompaniment pattern data.

11. The automatic accompaniment apparatus according to claim 1, wherein the display controller controls the display to display beat position information indicating which beat position in a measure the current position is at.

12. The automatic accompaniment apparatus according to claim 1, wherein:

the plurality of accompaniment element data sets correspond to combinations of a plurality of types of sections and a plurality of variations, and the display controller controls the display to display variation information indicating a variation at the current position.

13. An automatic accompaniment apparatus comprising:

a display; and a processor that is configured to:

determine a current position in a music piece in progress;

select an accompaniment element data set to be used out of a plurality of accompaniment element data sets every time the determined current position arrives at a predetermined switching position;

generate accompaniment data indicating automatic accompaniment based on the selected accompaniment element data set;

calculate time information corresponding to a time required until the determined current position arrives at a next switching position; and control a display to display arrival advance notice information indicating the calculated time information, wherein the displayed arrival advance notice information changes according to the calculated time information as the current position approaches the next switching position.

14. An automatic accompaniment method comprising:

determining a current position in a music piece in progress;

selecting an accompaniment element data set to be used out of a plurality of accompaniment element data sets every time the determined current position arrives at a predetermined switching position;

generating accompaniment data indicating automatic accompaniment based on the selected accompaniment element data set;

calculating time information corresponding a time required until the determined current position arrives at a next switching position; and controlling a display to display arrival advance notice information indicating the calculated time information, wherein the displayed arrival advance notice information changes according to the calculated time information as the current position approaches the next switching position.

15. The automatic accompaniment method according to claim 14, further comprising:

acquiring a tempo of the music piece, wherein the determining calculates the current position based on the acquired tempo.

16. The automatic accompaniment method according to claim 14, further comprising:

acquiring performance data indicating a user's performance, wherein the determining calculates the current position based on music piece data indicating the music piece and the acquired performance data.

17. The automatic accompaniment method according to claim 14, wherein:

the plurality of accompaniment element data sets include:

a plurality of main accompaniment element data sets to be used in each of a plurality of main sections, which are body portions of the music piece; and a plurality of fill-in accompaniment element data sets to be used in a fill-in section, which is disposed between at least two main sections, the switching position is a starting position of each main section, a starting position of the fill-in section is set at a position at a predetermined period before the switching position, the selecting selects:

a main accompaniment element data set to be used out of the plurality of main accompaniment element data sets every time the current position arrives at the switching position; and a fill-in accompaniment element data set to be used out of the plurality of fill-in accompaniment element data sets every time the current position arrives at the starting position of the fill-in section, and the controlling controls the display to display fill-in information indicating that the current position is in the fill-in section when the fill-in accompaniment element data set is selected.

18. The automatic accompaniment method according to claim 14, wherein the display controlling controls the display to further display a current position-in-measure indicating a relationship between the current position and a starting or ending position of a measure including the current position.

19. The automatic accompaniment method according to claim 14, further comprising:

acquiring performance data indicating a user's performance; and detecting a volume of the user's performance based on the acquired performance data, wherein the selecting selects an accompaniment element data set to be used based on the detected volume.

20. The automatic accompaniment method according to claim 1, wherein the switching position is set at a starting position of a main section.

* * * * *